US012768067B2

(12) United States Patent
Choi et al.

(10) Patent No.: US 12,768,067 B2
(45) Date of Patent: Oct. 20, 2026

(54) OIL-IMPREGNATED NANOPOROUS OXIDE COATINGS HAVING BOTTLE-SHAPED PORES

(71) Applicant: THE TRUSTEES OF THE STEVENS INSTITUTE OF TECHNOLOGY, Hoboken, NJ (US)

(72) Inventors: Chang-Hwan Choi, Tenafly, NJ (US); Junghoon Lee, Busan (KR)

(73) Assignee: THE TRUSTEES OF THE STEVENS INSTITUTE OF TECHNOLOGY, Hoboken, NJ (US)

( * ) Notice: Subject to any disclaimer, the term of this patent is extended or adjusted under 35 U.S.C. 154(b) by 823 days.

(21) Appl. No.: 17/976,614

(22) Filed: Oct. 28, 2022

(65) Prior Publication Data

US 2023/0175158 A1 Jun. 8, 2023

Related U.S. Application Data

(63) Continuation of application No. PCT/US2021/030329, filed on Apr. 30, 2021.
(Continued)

(51) Int. Cl.
*C25D 11/04* (2006.01)
*C25D 11/18* (2006.01)

(52) U.S. Cl.
CPC ..... *C25D 11/045* (2013.01); *C25D 11/18* (2013.01)

(58) Field of Classification Search
CPC ..... C25D 11/045; C25D 11/12; C25D 11/18; C25D 11/243; C25D 11/246
See application file for complete search history.

(56) References Cited

U.S. PATENT DOCUMENTS 1,768,528 A 6/1930 Short
9,512,537 B2 * 12/2016 Curran ..... C25D 11/26
(Continued)

FOREIGN PATENT DOCUMENTS

DE 276557 2/1990
EP 0389274 7/1994
(Continued)

OTHER PUBLICATIONS

Lee et al., Oill-Impregnated Aluminum Anodic Oxide Layer with Bottle-Shaped Pores for Enhanced Anti-Corrosion and Self-Healing Properties, ECS Meeting Abstracts, Sep. 2016, MA2016-02(12), 1283-1283 (Year: 2016).*
(Continued)

*Primary Examiner* — Hai Vo
(74) *Attorney, Agent, or Firm* — Clark Hill PLC; Ralph Selitto; John K. Kim

(57) ABSTRACT

A method for creating oil-filled porous anodic oxide coatings for metallic surfaces is disclosed. The coating has anti-corrosion and omniphobic properties to resist both underwater and atmospheric conditions. To realize oil-impregnated three-dimensional bottle-shaped pores in the oxide layer in anodizing aluminum, the following steps may be taken. First, the target surface may be cleaned and electropolished. Then, a first anodizing step at a lower voltage is applied to create relatively small-diameter pores in the entrance (i.e., top) region of the oxide layer, followed by a second anodizing step at a higher voltage to subsequently create larger-diameter pores in the base (i.e., bottom) region of the oxide layer. Pore widening follows to enlarge the overall pore diameters. To fill the porous coating with an oil, a solvent exchange method may be utilized.

5 Claims, 25 Drawing Sheets

Related U.S. Application Data

(60) Provisional application No. 63/018,367, filed on Apr. 30, 2020.

(56) References Cited

U.S. PATENT DOCUMENTS

| | | | | |
|---|---|---|---|---|
| 2005/0098441 | A1 | 5/2005 | Heppekausen | |
| 2014/0110263 | A1 | 4/2014 | Barbier | |
| 2014/0147627 | A1 | 5/2014 | Aizenberg | |
| 2015/0368823 | A1* | 12/2015 | Curran | C25D 11/16 205/52 |
| 2018/0094204 | A1 | 4/2018 | Laimer et al. | |
| 2019/0242026 | A1 | 8/2019 | Choi et al. | |

FOREIGN PATENT DOCUMENTS

| | | |
|---|---|---|
| JP | H11336763 | 12/1999 |
| JP | 2006062328 | 3/2006 |
| WO | 1994008073 | 4/1994 |

OTHER PUBLICATIONS

PCT International Search Report and Written Opinion for PCT/US2021/030329 entitled "Oil-Impregnated Nanoporous Oxide Coatings Having Bottle-Shaped Pores" mailed Feb. 3, 2022, 17 pages.

Lee, Jonghoon et al, "Oil-Impregnated Nanoporous Oxide Layer for Corrosion, Protection with Self-Healing," Advanced Functional Materials, [online], vol. 27, No. 15, Feb. 8, 2017 (Feb. 8, 2017), p. 1606040 (11 pages).

Lee, Junghoon et al, "Fluorocarbon lubricant impregnated nanoporous oxide for omnicorrosion-resistant stainless steel", Journal of Colloid and Interface Science, Acadmeic Press Inc, US, vol. 558, Sep. 30, 2019 (Sep. 30, 2019), pp. 301-309.

Jeong, C., et al, Air-Impregnated Nanoporous Anodic Aluminum Oxide Layers for Enhancing the Corrosion Resistance of Aluminum:, Langmuir, Sep. 22, 2015, vol. 31, p. 11040-11050.

Jeong, C., et al., "Single-step direct fabrication of pillar-on-pore-hybrid nanostuctures in anodizing aluminum for superior superhydrophobic efficiency" ACS Applied Materials & Interfaces, 2012, 4, 842-848.

Jeong, C., et al., "Corrosion resistance of nanoporous superhydrophobic surfaces of anodic aluminum oxide", 2012, Honolulu, HI, The Electrochemical Society, ECS Meeting Abstract No. 2240.

Lee, J, et al; "Oil-Impregnated Anodic Aluminum Oxide Layers for Omniphobic Surfaces" Abstract in the "Tenth International Symposium on Contact Angle, Wettability, and Adhesion", 2016, p. 16.

Lee, W, et al., "Porous Anodic Aluminum Oxide: Anodization and Templated Synthesis of Functional Nanostructures", Chemical Reviews, 2014, vol. 114, p. 7487-7556.

Lee, J. et al., "Oil-impregnated Nanoporous Oxide Layer of Anodized Stainless Steel for Omniphobic and Anti-corrosive Surfaces", 2016, The Electrochemical Society, ECS Meeting Abstracts, vol. MA2016-02, 1284.

PCT International Search Report and Written Opinion for PCT/US2021/028982 entitled "Anti-Corrosive Oil-Impregnated nanoporous Oxide Coating for Stainless Steel" mailed Oct. 7, 2021, 15 pages.

PCT IPRP for PCT/US2021/028982 entitled "Anti-Corrosive Oil-Impregnated nanoporous Oxide Coating for Stainless Steel" mailed Oct. 25, 2022, 8 pages.

US—Korea Conference, "Symposium Program," 2016, pp. 1-50.

Wang, P., et al., "Slippery Liquid-Infused Porous Surface Bio-Inspired by Pitcher Plant for Maine Anti-Biofouling Application", Colloids and Surfaces B: Biointerfaces 136 (2015) 240-247, (Year 2015).

Lee, et al., "Oil-Impregnated Anodic Aluminum Oxide Layers for Omniphobic Surface", Department of Mechanical Engineering, Stevens Institute of Technology, (Jul. 15, 2016), 15 pages.

Kure et al., "Formation of self-organized nanoporous anodic films on Type 304 stainless steel," Electrochemistry Communications, V. 21, 1-4, 2012.

Office Action for U.S. Appl. No. 17/971,328, entitled "Anti-Corrosive Oil-Impregnated Nanoporous Oxide Coating for Stainless Steel," 19 pages, issued Dec. 2, 2024.

Anand et al., "Enhanced Condensation on Lubricant-Impregnated Nanotextured Surfaces," ACS Nano, vol. 6, No. 11, 10122-10129 (2012).

Choi "Oil-Impregnated Anodic Aluminum Oxide Layer for Enhanced Anti-Corrosion and Self-Healing Properties," Department of Mechanical Engineering, Stevens Insitute of Technology, (Aug. 11, 2016), 22 pages.

Kim et al., "Liquid-Infused Nanostructured Surfaces with Extreme Anti-Ice and Anti-Frost Performance," ACS Nano, vol. 6, No. 8, pp. 6569-6577 (2012).

Wang et al., Slippery Liquid-infused Porous Surface Bio-inspired by Pitcher Plant for Marine Anti-biofouling Application, Colloids and Surfaces B: Biointerfaces 136 (2015) 240-247.

Smith et al., "Droplet mobility on lubricant-impregnated surfaces," Soft Matter, vol. 9, No. 6, 1772-1780 (Feb. 14, 2013).

Wong et al., "Bioinspired self-repairing slippery surfaces with pressure-stable omniphobicity," Nature, vol. 477, 443-447, Sep. 22, 2011.

Yao et al., "Adaptive fluid-infused porous films with transparency and wettability," Nature Materials, vol. 12, 529-534, Jun. 2013.

* cited by examiner

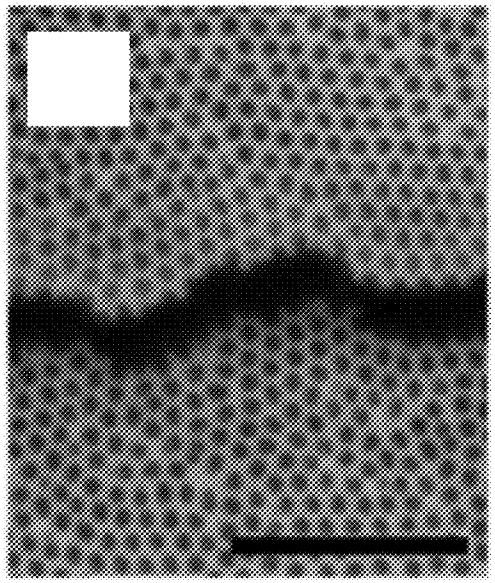
FIG. 4A2
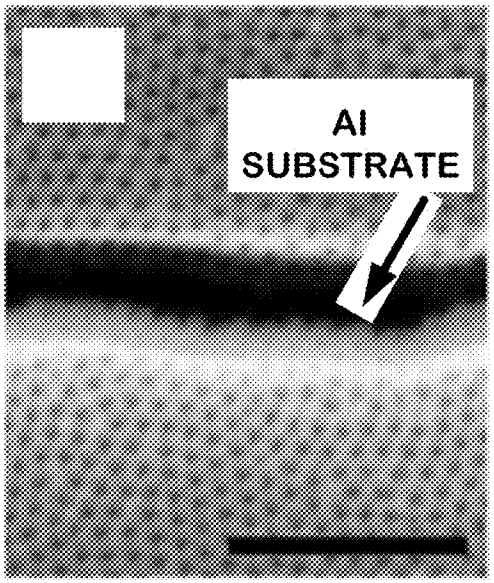
FIG. 4A1
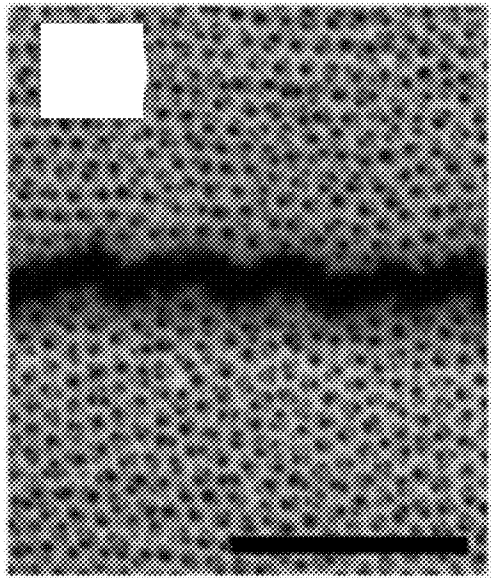
FIG. 4A4
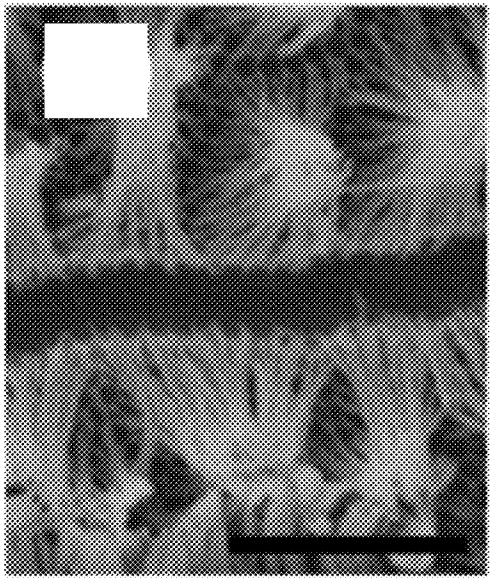
FIG. 4A3

OIL-IMPREGNATED NANOPOROUS OXIDE COATINGS HAVING BOTTLE-SHAPED PORES

CROSS-REFERENCE TO RELATED APPLICATION

This application is a continuation of PCT Application PCT/US2021/030329 filed Apr. 30, 2021, which claims priority to U.S. Provisional Patent Application Ser. No. 63/018,367 filed Apr. 30, 2020, the entire disclosures of both of which applications are incorporated herein by reference.

STATEMENT OF GOVERNMENT INTEREST

This invention was made with government support under Award No. N00014-14-1-0502 awarded by the Office of Navy Research (ONR) of the United States Navy. The government has certain rights in the invention.

FIELD OF THE INVENTION

The present invention relates to anti-corrosion coatings. More specifically, it relates to coatings that can be applied to aluminum and other metals to provide insulation against deleterious operating conditions.

BACKGROUND OF THE INVENTION

Corrosion causes many serious problems that limit the satisfactory operating lifetime of metallic materials. Therefore, corrosion-resistant surfaces for metallic materials are of great importance in a broad range of engineering systems and applications. For decades, various strategies have been employed to prevent the corrosion of metallic materials in service environments. For example, thin organic (or polymer) coatings, such as simple painting, spraying and shrink-wrapping, have proven convenient and are widely used ways to form passive layers on metals. Although these organic coatings inhibit the mass transfer of corrosion reactants (e.g., water, oxygen and chloride), they can be easily degraded by UV exposure and temperature changes. Such degradation allows the corrosion reactants to be transported to the metal/polymer interface, resulting in crevice corrosion and delamination of the coatings from metallic surfaces.

Anodizing (or anodic oxidation) has been widely used in the manufacturing industry to build up a thick oxide layer with cylindrical pores on various metals, such as aluminum, titanium, vanadium, zirconium, hafnium, niobium, tantalum, tungsten, etc. Especially, as aluminum alloys are used in diverse application fields, anodizing of aluminum and its alloys is the most widely explored and commercialized way for corrosion/wear resistance, surface coloring, and so forth. Additional sealing treatments of the porous anodic aluminum oxide (AAO) enable further improvement in the corrosion resistance by inhibiting the penetration and diffusion of corrosive medium into the porous oxide layer by filling the pores with solid materials. However, the initial absorption of corrosive liquid in the porous AAO with a sealing treatment is unavoidable. In contrast, hydrophobic or omniphobic coatings on AAO significantly reduces the absorption of corrosive liquid on solid AAO structures by impregnating air (gas) or oil (liquid) within the nanoporous structures, so that they allow the enhancement of corrosion resistance. In particular, omniphobic surfaces fabricated by impregnating perfluorinated oil into the nanoporous structures of AAO have been reported to show not only a significantly improved anti-corrosion performance in chloride environments but also unique self-healing and cleaning properties.

As the penetration of corrosive medium into the pores of AAO is a main cause of the corrosion of conventional anodized aluminum (see, for example, U.S. Patent Application Publication No. 2019/0242026, which is incorporated herein by reference), the oil impregnated within the porous AAO can function as a barrier to inhibit the contact and penetration of corrosive medium toward the aluminum substrate, leading to the improvement of corrosion resistance. Therefore, a high level of stability of oil in the pores of AAO is essential in the robust protection from the corrosion. Whereas the geometrical features of porous structures and the liquid properties of the impregnated oils (e.g., viscosity) are expected to affect such performance, only limited types of porous structures (e.g., cylindrical pores) and oils have been explored for these purposes.

Since lubricant-impregnated or lubricant-infused surfaces were first recognized as one approach to achieving liquid-repellant properties, especially for the corrosion-resistant coating of metals, they have garnered significant attention in a wide range of applications to solve various problems on solid surfaces. Due to the mobile and low surface tension lubricant layer, most liquids (e.g., water and aqueous corrosive media) are effectively repelled from the surface, resulting in the protection of the metal surface against corrosive liquids. However, these prior approaches, which mainly use interconnected porous structures, have proven prone to lose lubricant out of the pores, making such treatments ineffective in real applications with practical limitations, such as longevity and robustness of the surfaces.

SUMMARY OF THE INVENTION

The present invention, whether in the form of a surface/material, fabrication process and/or new use/application, can be employed for the effective prevention and inhibition of corrosion of aluminum and its alloys with enhanced performance and durability. Generally, the present invention is useful in improving the corrosion resistance of oil-impregnated nanoporous oxide layers of aluminum and its alloys. The present invention also has utility when applied to other metallic materials used commercially for anti-corrosion with durability, or applied for other applications, including hydrodynamic drag reduction, anti-icing, and anti-fouling.

More specifically, one aspect of the present invention is directed to the geometrical features of the porous structures, which features affect the immobilization of oil in the pores significantly, and hence affect the corrosion resistance and durability, as well as the self-healing capability.

Another aspect of the present invention is directed to the liquid properties of the lubricant, such as the viscosity of oil, which properties also significantly affect the immobilization of the oil in the pores, corrosion resistance, durability, etc. For instance, a metallic surface coating can include nanopores distributed throughout the coating that have hydrophobic properties. The pores can include liquid oil/lubricant that displaces any stored air. The efficacy of the system can be further improved by using liquid oil having a viscosity greater than 1 cSt.

By combining these two aspects of the invention (e.g., using bottle-shaped pores impregnated with a high-viscosity oil), the efficacy and durability of oil-impregnated nanoporous oxide layer/coating for inhibiting corrosion of metal substrates will be significantly enhanced.

The present invention can be used as a surface treatment method, which improves surface properties of base materials or provides for new surface functionalities. In particular, the invention can be used to enhance the durability of an oil-impregnated nanoporous surface of metals. One embodiment of the invention involves a unique nanopore geometry having a three-dimensional bottle-shaped pore in an anodic oxide layer. As used herein, the term "bottle-shaped pore" or any variants thereof shall be defined as a pore having a smaller pore diameter in the entrance (or top) region than in the base (or bottom) region.

In another embodiment, the invention involves a method for forming such "bottle-shaped pores" and the like. In accordance with one embodiment of such a method, once lubricant (i.e., oil) is fully filled within the bottle-shaped pore, it is not easy to remove the lubricant (oil) infused within the pore due to its unique three-dimensional geometry, as described above. Moreover, if the bottle-shaped pores are impregnated with oil having a higher viscosity, the effect is more pronounced combining the advantages of both aspects of the present invention. For example, an oxide layer with a plurality of bottle-shaped pores impregnated with a high-viscosity oil exhibits better corrosion resistance with enhanced durability and self-healing properties, compared to the results achieved with simple straight pores and/or the pores impregnated with a low-viscosity oil.

The present invention could benefit the US Army, Navy, Air Force, etc., as corrosion is among the most serious problems and issues in the mechanical systems used by such organizations, such as tanks and aircraft. Many manufacturing companies (e.g., automotive and oil companies, etc.) may also benefit from the present invention since corrosion is also is one of the critical issues in such companies' applications and products

BRIEF DESCRIPTION OF THE DRAWINGS

For a better understanding of the present invention, reference is made to the following detailed description of various exemplary embodiments considered in conjunction with the accompanying drawings, in which:

FIGS. 4A1-4A4 are a scanning electron microscope (SEM) images of intentionally damaged (i.e., cracked by bending) oil-impregnated anodic aluminum oxide surfaces;

DESCRIPTION OF EMBODIMENTS OF THE INVENTION

Figure 1B:
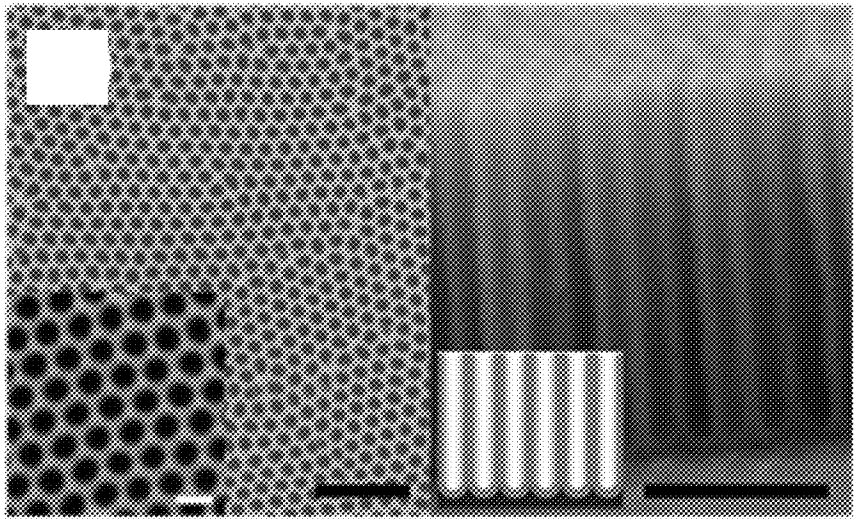
FIGS. 1A-D depict top (left) and cross-sectional (right) views of aluminum oxide structures with oil impregnation for small-pores (S-Po), large-pores (L-Po), bundle-pillars (B-Pi) and bottle-shaped-pores (B-Po), respectively, the bottom left inset in each figure showing the top view with high magnification, and the bottom right inset in each figure showing the schematic cross-section.

Various embodiments of the present invention are disclosed herein; however, it is to be understood that the disclosed embodiments are merely illustrative of the invention that can be embodied in various forms. In addition, each of the examples given in connection with the various embodiments is intended to be illustrative, and not restrictive. Further, the figures are not necessarily to scale, and some features may be exaggerated to show details of particular components (and any size, material and similar details shown in the figures are intended to be illustrative and not restrictive). Therefore, specific structural and functional details disclosed herein are not to be interpreted as limiting, but merely as a representative basis for teaching one skilled in the art to variously employ the disclosed embodiments.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or disclosed subject matter is intended to be construed as not being limited to any exemplary embodiments set forth herein, it being understood that such exemplary embodiments are provided merely to be illustrative. Among other things, for example, subject matter may be embodied as methods, devices, components, or systems. The following detailed description is, therefore, not intended to be taken in a limiting sense.

Throughout the specification, terms may have nuanced meanings suggested or implied in context beyond an explicitly stated meaning. Likewise, the phrase "in one embodiment" as used herein does not necessarily refer to the same embodiment and the phrases "in another embodiment" and "other embodiments" as used herein do not necessarily refer to a different embodiment. It is intended, for example, that covered or disclosed subject matter includes combinations of the exemplary embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

The present invention can be used as a surface treatment method, which improves surface properties of metallic surfaces or allows new surface functionalities. For example, when the treated surface is exposed to external environments, the surface treatment method of the present invention can protect the inner material from being corroded and degraded by the external environment. The present invention uses an oil-impregnated nanoporous oxide layer for anti-corrosion, which is directly grown on a metal surface. One implementation is to directly create a nanoporous oxide layer on the metal surface and fill corrosion-resistant liquid oil into the nanopores so that the retained oil layer on the surface efficiently insulates the substrate from outer corrosive environments (e.g., salty water and the atmosphere). Since the oil has repellency to water-based liquid and vapor, corrosive media from liquid and vapor cannot penetrate into the pores of the oxide layer on the metal surface so that the corrosion of metal surfaces under the oxide layer is significantly impeded.

The corrosion resistance of the oil-impregnated nanoporous oxide layer or coating functions as a barrier layer for inhibiting corrosion of metal substrates that would otherwise be degraded by the depletion of oil out of the pores. Thus, well-controlled pore geometry adapted to better retain oil within the pores (i.e., more stably) will efficiently impede the degradation of the anti-corrosive property by the potential loss of oil. A bottle-shaped pore geometry was created via an anodizing step, by which anodizing voltage is selectively controlled, and via a pore-widening step, which results in a pore having a smaller diameter in the entrance region of the pore than in its base (i.e., a so-called "bottle-shaped pore"). Compared to pores with straight walls, these bottle-shaped pores exhibit enhanced stability of oil within the pores. Thus, the surface of the metal substrate shows enhanced corrosion resistance.

In addition, oil with higher viscosity is retained better (more stably) within the pores, whether bottle-shaped or otherwise, compared to the retention of oils with lower viscosity, thereby resulting in enhanced performance. Therefore, two unique features of the present invention are: (i) the formation of three-dimensional bottle-shaped pores and (ii) impregnation of such pores with an oil having a higher viscosity. The combination of these features leads to the enhancement of the stability of oil retention in the nanoporous oxide layer, and hence an increase in the corrosion resistance and durability of the metal substrates.

As described above, once the lubricant (i.e., oil) is fully filled in the bottle-shaped pores of the present invention, it is not easily removed due to the unique three-dimensional geometry of the pores. Moreover, if the bottle-shaped pores are impregnated with oil having a higher viscosity, this effect is even more pronounced. Specifically, an oxide layer with the bottle-shaped pore impregnated with a high-viscosity oil shows better corrosion resistance with enhanced durability and self-healing properties, relative to those achieved using straight-sided pores and/or pores impregnated with a low-viscosity oil.

To form oil-impregnated, three-dimensional bottle-shaped pores in the oxide layer of anodized aluminum, the following steps may be taken. First, the target surface may be cleaned and electropolished. Then, a first anodizing step at a lower voltage is applied to create relatively small-diameter pores in the entrance (i.e., top) region of the oxide layer, followed by a second anodizing step at a higher voltage to subsequently create larger-diameter pores in the base (i.e., bottom) region of the oxide layer. Pore widening may follow to enlarge the pore diameters in both the top and bottom regions, but while maintaining the overall bottle shape of the widened pore. A solvent exchange method can be then used to impregnate the pores with protective oil. Exemplary steps can include: hydrophobizing the surfaces (e.g., spin-coating with the compound sold under the trademark of Teflon®), filling the pores with ethanol (or equivalent alcohol), replacing the ethanol with a solvent of oil, and replacing the solvent with oil.

The anti-corrosion performance of the oil-impregnated anodic aluminum oxide (AAO) layer with the bottle-shaped pore was compared with AAO layers with typical cylindrical pores as well as pillar structures. It was demonstrated that the bottle-shaped pores stably immobilized the oil in the nanostructure, showing robust corrosion resistance for corrosive media containing chloride. In addition, the larger volume of oil in the bottle-shaped pores more effectively covered the underlying metallic aluminum surface exposed by cracks, indicating its damage (e.g., crack) tolerance for corrosion with a unique self-healing capability. Moreover, high viscous oil-impregnated, bottle-shaped pores of AAO were more effective to enhance not only corrosion resistance, but also self-healing capabilities.

Figure 1D:
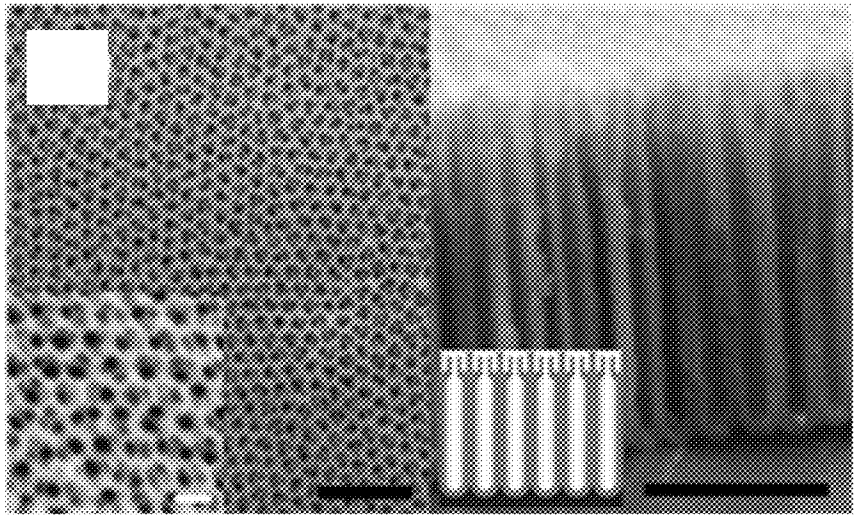
Figure 1A:
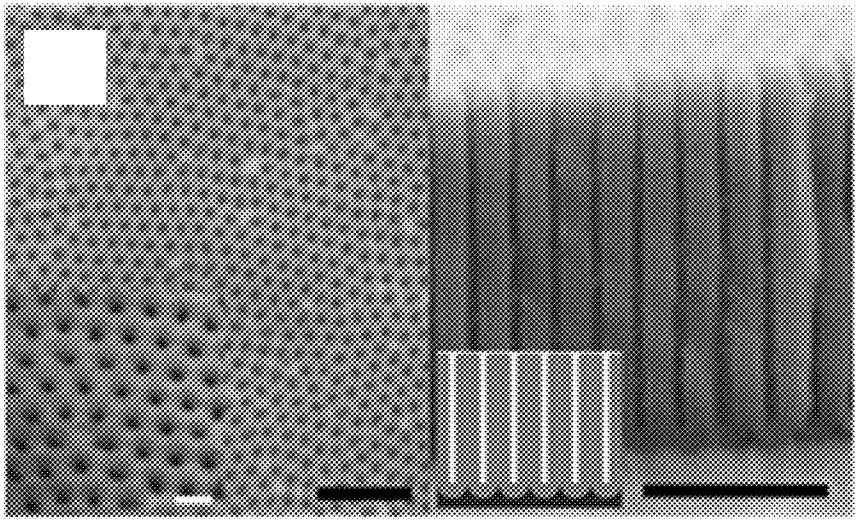
Figure 1C:
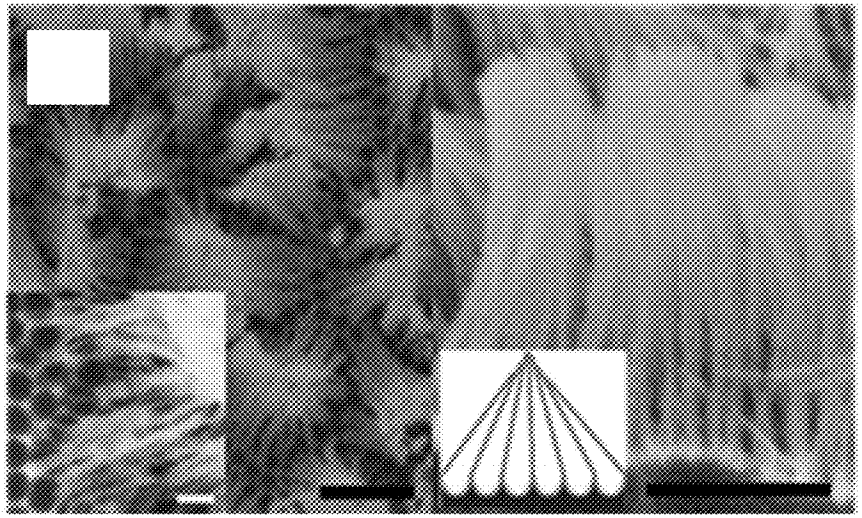

Magnified images of various porous anodic oxide structures are shown in FIG. 1, which shows small pores (FIG. 1A), large pores (FIG. 1B), bundle-pillared pores (FIG. 1C), and bottle-shaped pores (FIG. 1D). The left portion of each individual figure depicts a top view, while the right portion is a cross-sectional view. In each figure, the black bars represent lengths of 100 nm and 500 nm in the left and right portions, respectively.

To be more specific, the bottle-shaped pores featuring a smaller pore diameter at the upper layer than at the lower layer enhanced the stability of oil in the pores by more than 60% compared to conventional nanoporous oxide layers with cylindrical pores, whereby a highly robust and stable non-wetting surface against corrosive liquid was established on, for example, aluminum. As the smaller pore diameter at the upper layer of the bottle-shaped pore functions to immobilize the oil by reducing the contact of water, the surface has exhibited an enhanced corrosion resistance by more than five orders of magnitude compared to bare aluminum and hence shows greater stability in the environments which cause the loss of oil, such as by vibration. In addition compared to conventional nanoporous oxide layers with cylindrical pores, the larger pore diameter at the lower layer of the bottle-shaped pores gives more space for the impregnation of oil, thereby providing a 29-fold higher tolerance to damage in the oxide layer by inhibiting the exposure of aluminum surface to such environments. Meanwhile, the corrosion current density of low-viscosity oil (e.g., K100) impregnated in bottle-shaped pores decreases by 111.5% under ultrasonication for 450 sec. In contrast, when high-viscosity oil (e.g., K106) is impregnated in the pores, the decrease of corrosion current density in 450 sec.

of ultrasonication is 81.9%, which is significantly lower than the case of low-viscosity oil (e.g., K100). Moreover, in the case of low-viscosity oil (K100), the corrosion current density increases by 1.5 fold when cracks occur on the oxide layer. In contrast, the corrosion current density in the case of high-viscosity oil (K106) increases by 1.2 fold with cracks, which is also significantly lower.

Figure 2:
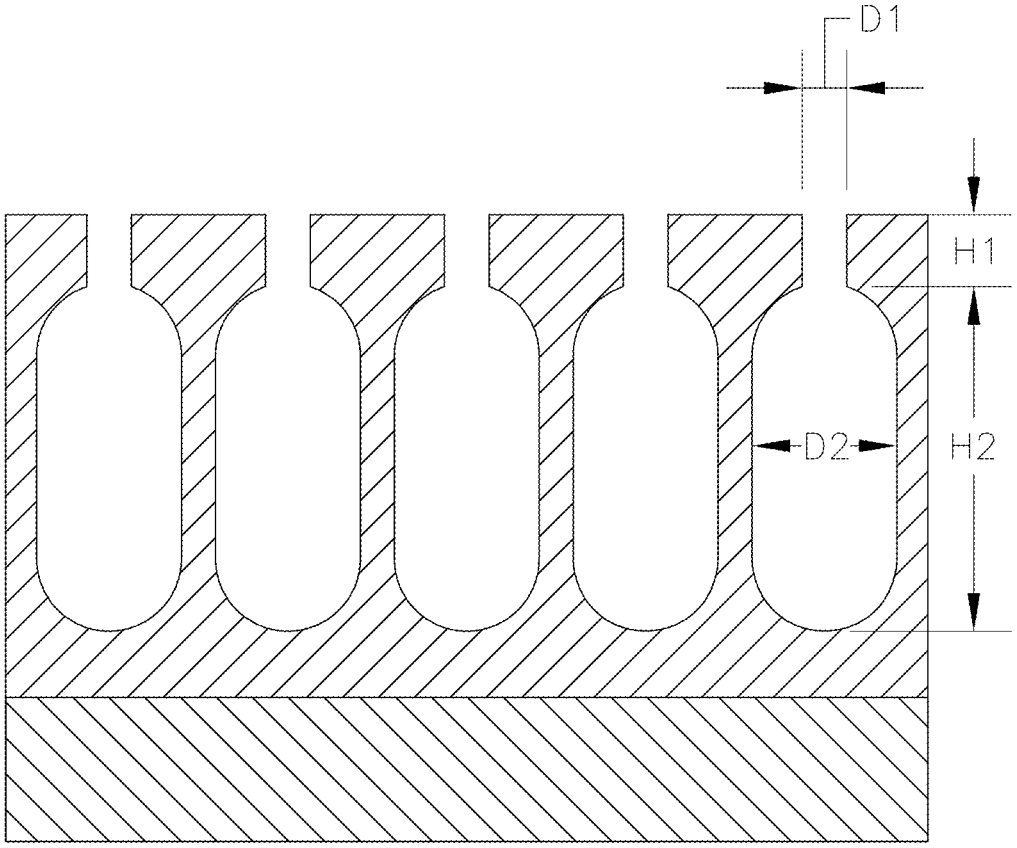
FIG. 2 is a schematic, cross-sectional view of bottle-shaped pores in accordance with an embodiment of the present invention.

FIG. 2 is a schematic cross-sectional view of bottle-shaped pores and exemplary dimensions associated therewith, in accordance with an embodiment of the present invention. D1 refers to pore diameter in an upper layer; it can range from about 20 nm to about 200 nm. D2 refers to a pore diameter of a lower layer; it can range from about 30 nm to about 500 nm. In an embodiment, the recommended ratio of the pore diameters, D2/D1 is no less than 1.5. It is expected that the greater the ratio (D2/D1) is, the better performance the nanoporous oxide layer will show. H1 represents the thickness of a upper layer; in an embodiment, H1 is greater than D1 and/or the ratio H1/D1 is greater than 1. H2 represents the thickness of a lower layer; in an embodiment, H2 is greater than D2 and/or the ratio H2/D2 is greater than 1.

In a further embodiment, the ratio of the thicknesses, H2/H1 is no less than 1. It is expected that the greater the ratio (H2/H1) is, the better performance the nanoporous oxide layer will show.

As for the viscosity of oil which is impregnated into the pores, it is expected that the greater viscosity an oil has, the better performance the nanoporous oxide layer will show. The typical range of commercially-available oil is on the order of about 10 cSt to about 1000 cSt (at 20° C.).

Example 1: Fabrication of AAOs with Various Pore Sizes and Shapes

An anodizing procedure for aluminum to fabricate bottle-shaped pores that feature a smaller pore diameter at the upper layer than at the lower layer was developed. FIG. 1 shows SEM images of AAO structures coated with Teflon® polymer, which is also known as polytetrafluoroethylene (PTFE), including small pore (S-Po), large pore (L-Po), bundled pillar (B-Pi), and bottle-shaped pore (B-Po) embodiments, used for the impregnation of oil. The two-step anodizing resulted in well-ordered pore structures of aluminum oxide on the aluminum substrate. The second anodizing under 40 V for 30 min resulted in an oxide layer of 1 μm thick with the cylindrical pores of 100 nm for inter-pore distance and 20 nm for pore diameter in a hexagonal array, referred to as S-Po, and shown in FIG. 1A. The large pore (L-Po, FIG. 1B) with the pore diameter of 70 nm was fabricated through an additional pore-widening step for 60 min applied to the S-Po. The pore-widening did not affect the inter-pore distance of the pore array. Further pore-widening for 100 min resulted in bundled pillar structures (B-Pi, FIG. 1C), wherein the individual nanowire structures first emerged via the over-etching of the pore walls and were then self-aggregated by the capillary force in drying to form clustered conical pillar structures. Meanwhile, the bottle-shaped pores (B-Po, FIG. 1D), which have a smaller pore diameter at the upper layer (about 36 nm) than that at the lower layer (about 65 nm), were fabricated by the voltage modulation from a lower voltage (e.g., 20 V) for the upper layer, and then a higher voltage (e.g., 40 V) for lower layer, followed by the pore-widening. In the cases of S-Po, L-Po and B-Po, the nanopores were isolated from neighboring pores by cell walls, whereas the B-Pi showed interconnected pores through the bundled pillars due to the excessively dissolved cell walls. Structural features of the nanostructures are summarized in Table 1 below, including the pore/pillar diameter, inter-pore/pillar distance, and porosity or air-fraction at the surface.

TABLE 1

Structural morphology and dimensions of the AAO nanostructures.

| | Structural morphology | Pore or pillar diameter (nm) | Interpore or interpillar distance (nm) | Porosity or air fraction at surface (%)* |
|---|---|---|---|---|
| S-Po | Disconnected pores | 20 ± 2 | 100 ± 3 | 4 ± 1 |
| L-Po | Disconnected pores | 74 ± 3 | 100 ± 2 | 50 ± 5 |
| B-Pi | Bundled pillars | 35 ± 14 (diameter of a clustered conical tip) | 340 ± 110 (distance between the clustered conical tip) | 95 ± 1 |
| B-Po | Disconnected pores | 36 ± 4 (at top)<br>69 ± 4 (at bottom) | 47 ± 4 (at top)<br>105 ± 6 (at bottom) | 53 ± 20 |

For the pore nanostructures (S-Po, L-Po and B-Po), the porosity (i.e., air fraction=1−solid fraction) was estimated from the pore diameter and inter-pore distance in the hexagonally packed pore array. In case of the bundled pillar nanostructure (B-Pi), the air fraction was estimated as the ratio of the open area on the top plane to the projected (flat) area of the surface.

Example 2: Effects of Pore Geometry on Corrosion Resistance

Figure 3A:
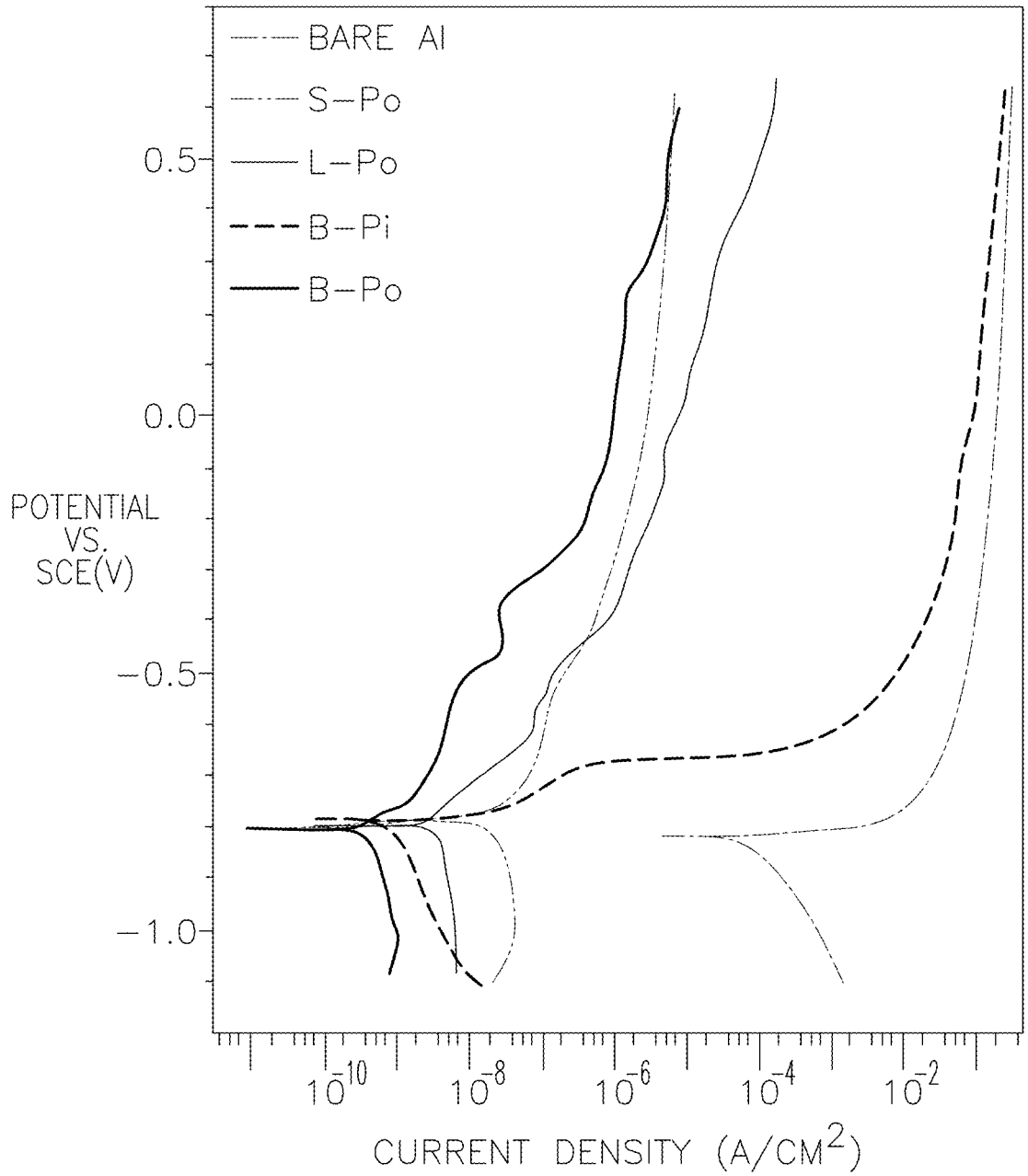
FIGS. 3A-3F are graphs showing corrosion resistance of oil-impregnated anodic aluminum oxide layers in 1 M HCl solution.
Figure 3B:
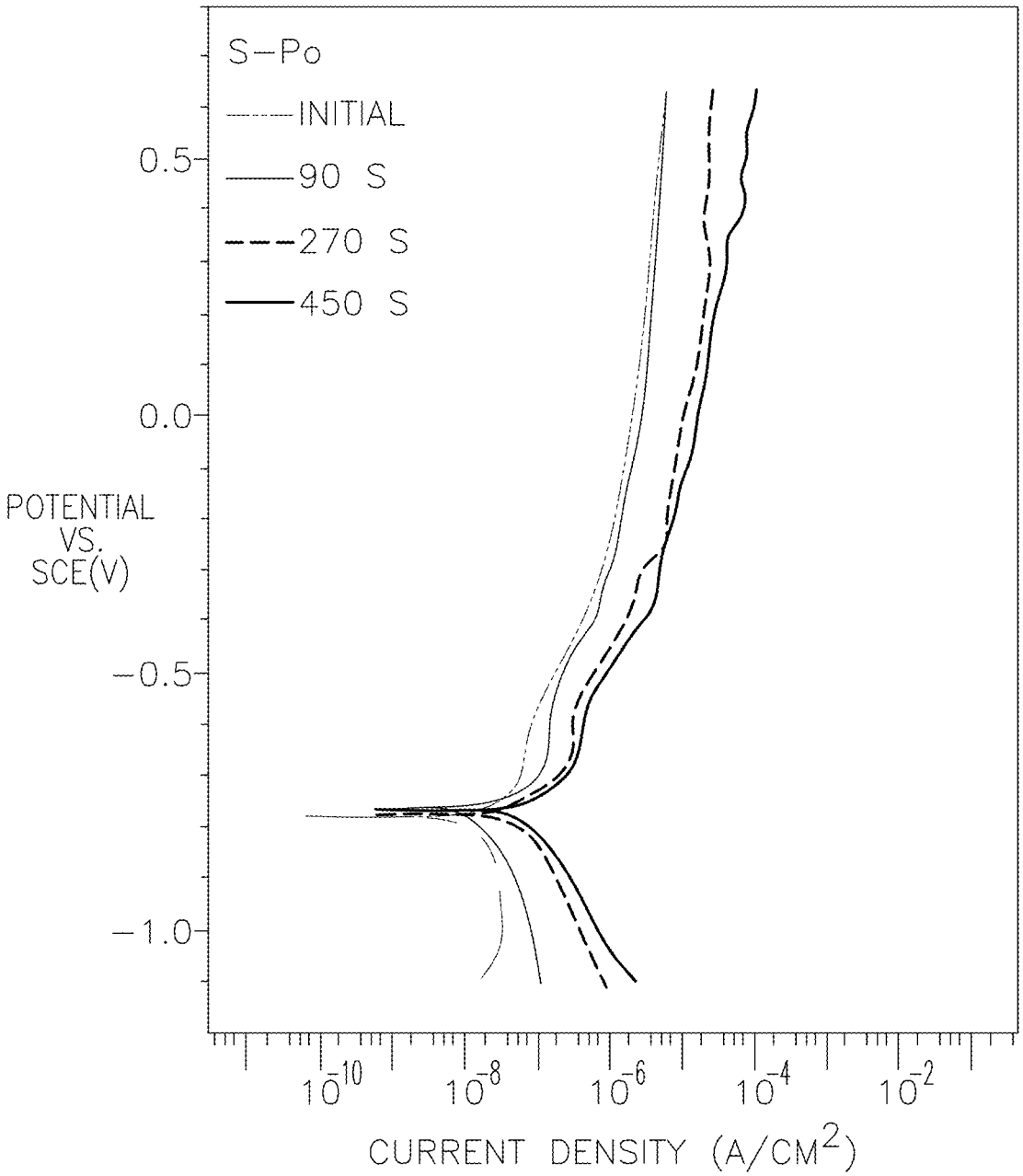
Figure 3C:
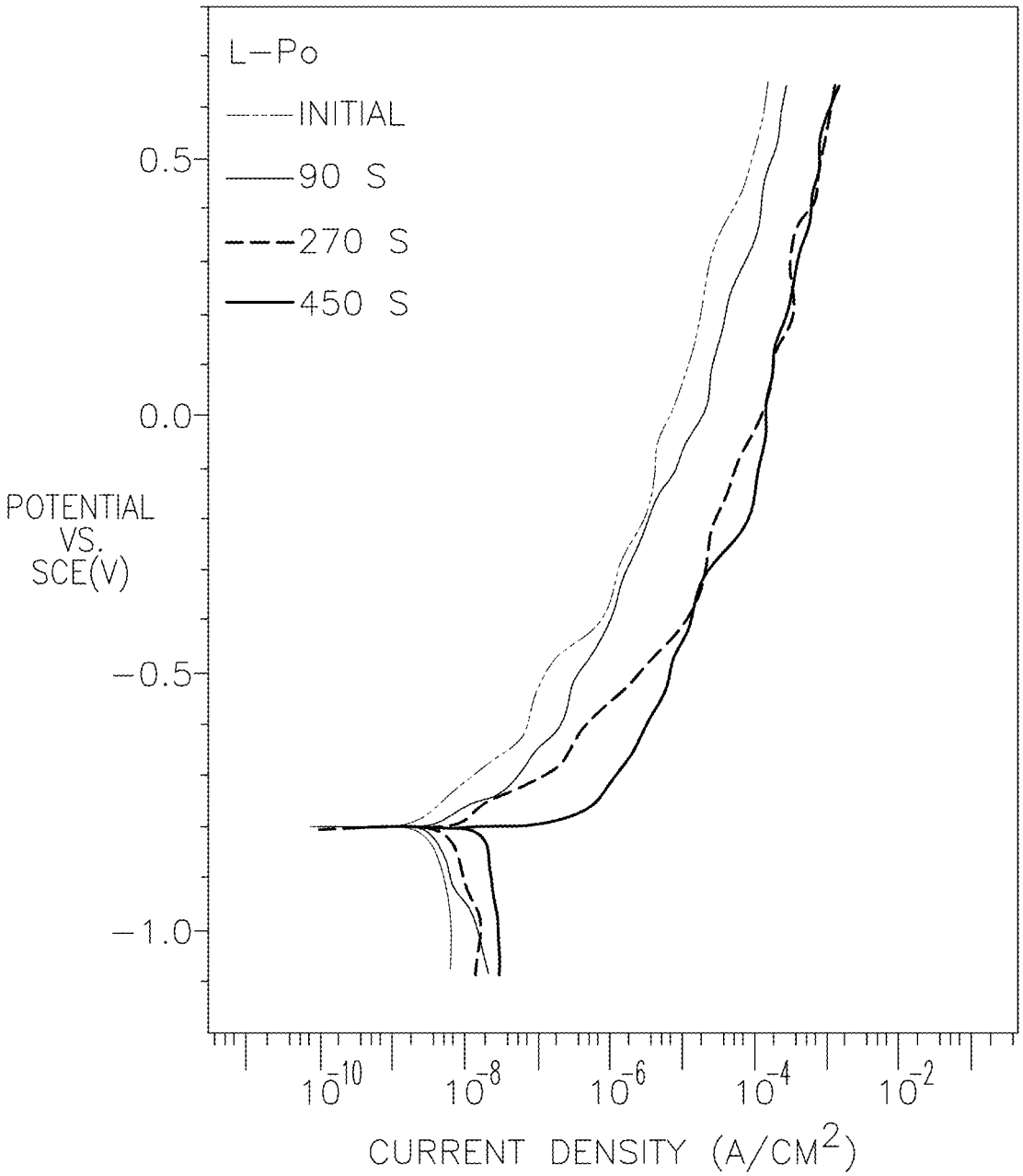
Figure 3D:
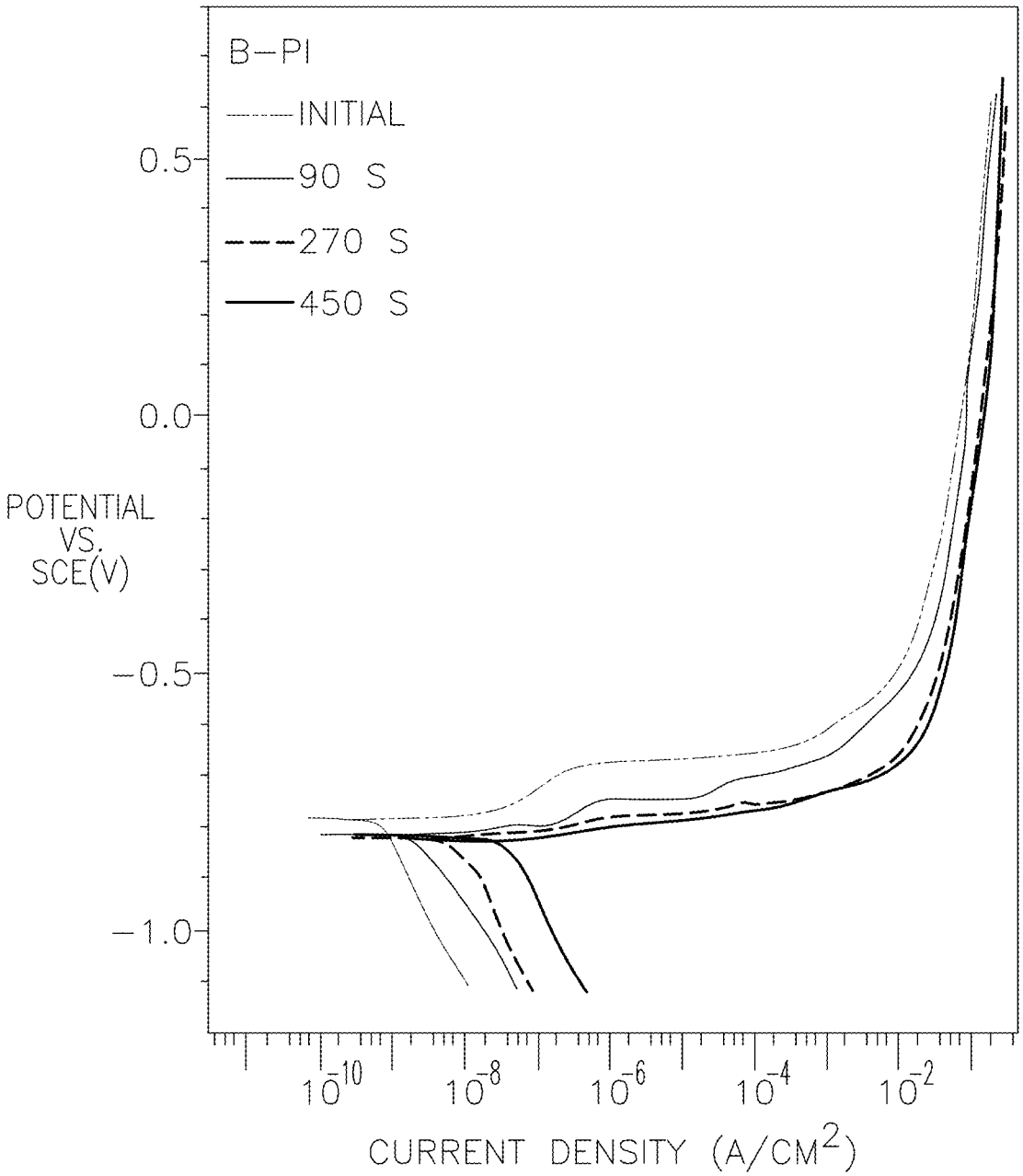
Figure 3E:
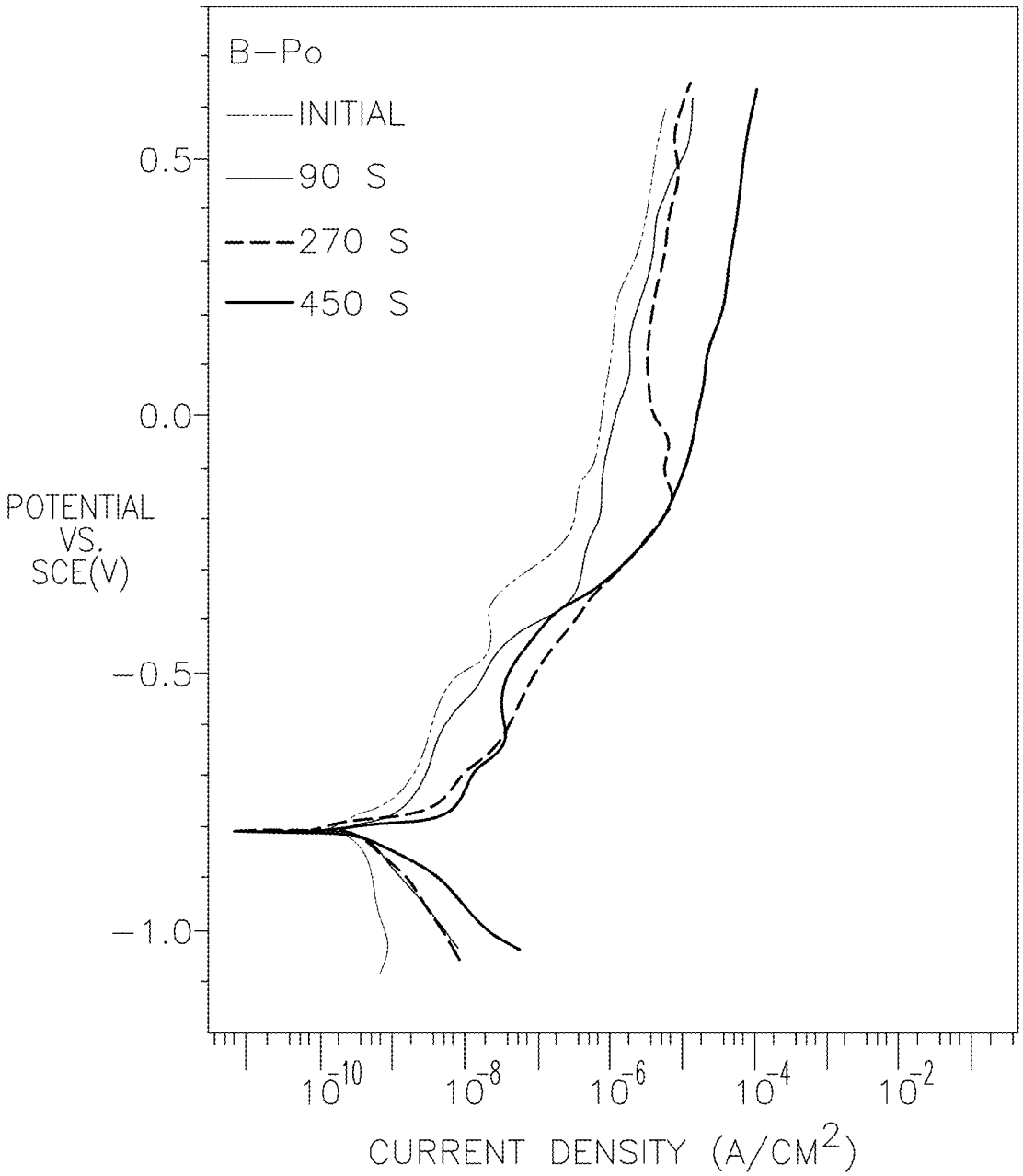

The oil within the pores inhibits the penetration of corrosive media toward the aluminum substrate. Thus, the retentivity of oil, which is affected by the size and shape of the nanostructures of AAOs, is important for the longevity and durable anti-corrosion efficacy of the oil-impregnated AAOs. FIG. 3A shows the potentiodynamic polarization curves measured in 1 M HCl solution to evaluate the corrosion resistance of as-fabricated oil (Krytox™ GPL 100)-impregnated AAOs. The oil impregnation into the perfluorinated AAOs significantly decreases the corrosion current density at least more than four orders of magnitude than bare aluminum. Compared to that of bare aluminum ($1.64\times10^{-4}$ A/cm$^2$), the corrosion current density of S-Po, L-Po, B-Pi and B-Po are $1.90\times10^{-8}$, $3.79\times10^{-9}$, $8.40\times10^{-10}$ and $4.87\times10^{-10}$ A/cm$^2$, respectively. Comparing the surfaces made at the same anodizing voltage with the only the difference being the pore-widening time (S-Po, L-Po and B-Pi), it is revealed that the corrosion current density decreases with the increase in the pore-widening time, which leads to an increase in the porosity (or a decrease of the solid fraction) at the surface. Such a comparison also indicates that higher porosity generally allows for greater amounts of oil to be impregnated in the surface, better passivating the solid surface of AAO.

However, the current density for B-Pi was rapidly increased by an electric potential sweep towards the anodic direction, seeing an increase similar to that of bare Al. This suggests that the B-Pi structures having inter-connected pores can easily allow the penetration of corrosive liquid into the inside pores when the corrosion potential approaches the anodic potential, accelerating the corrosion of the aluminum substrate. In contrast, the increase in the corrosion current in S-Po and L-Po by the polarization toward the anodic direction is much lower than that in B-Pi. Moreover, S-Po shows a smaller increase in the current density at anodic potential than L-Po, and eventually the current density in S-Po becomes lower than that in L-Po by over −0.440 V. This also suggests that the cylindrical pore shape with a smaller pore diameter is actually more effective in inhibiting the penetration of corrosive liquid into the pores and, hence, prevents the corrosion of the Al substrate. Meanwhile, the B-Po structure showed the lowest corrosion current density among the samples tested and also had the lowest current at anodic potential. The B-Po features the advantages of both high porosity (comparable to L-Po) and small pore diameter on the top surface (comparable to S-Po). Thus, the unique bottle-shaped pore geometry is effective in both reducing the corrosion current density and preventing the penetration of corrosive liquid into the pores.

Figure 3F:
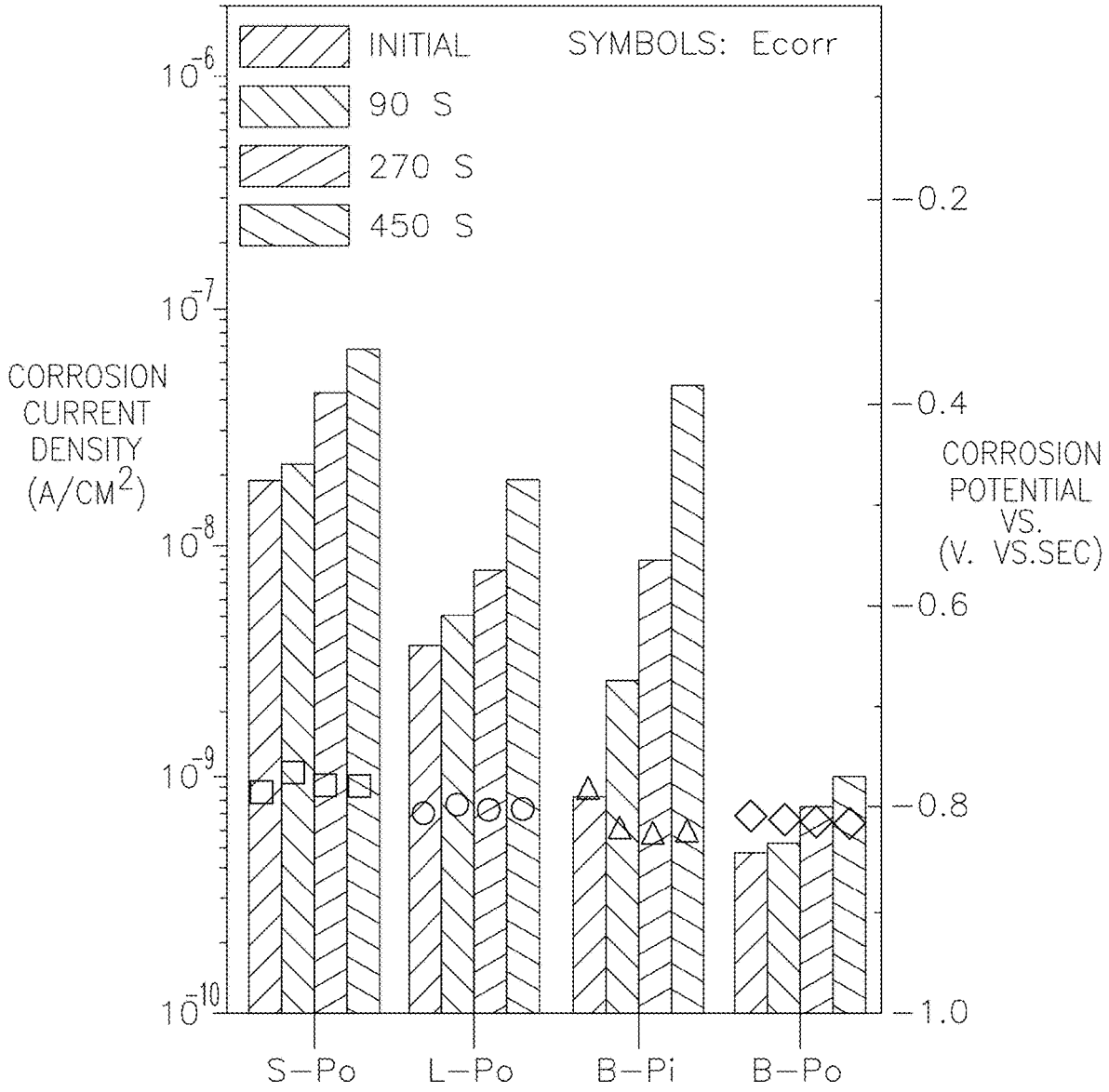

FIGS. 3B-3E further show the potentiodynamic polarization curves of the surfaces (i.e., S-Po, L-Po, B-Pi and B-Po) measured after ultrasonication in water with the varying durations. The increase in the corrosion current density by the different ultrasonication durations is also summarized in FIG. 3F. Whereas the change in the corrosion potential with the ultrasonication was not significant (only being significant for B-Pi), the change in the corrosion current density was significant and affected by the pore size and shape. The corrosion current density increased from $1.90\times10^{-8}$ to $2.23\times10^{-8}$ to $3.81\times10^{-8}$ to $6.30\times10^{-8}$ A/cm$^2$ in S-Po, from $3.79\times10^{-9}$ to $4.97\times10^{-9}$ to $7.96\times10^{-9}$ to $1.93\times10^{-8}$ A/cm$^2$ in L-Po, from $8.40\times10^{-10}$ to $2.69\times10^{-9}$ to $8.83\times10^{-9}$ to $4.89\times10^{-8}$ A/cm$^2$ in B-Pi, and $4.87\times10^{-10}$ to $5.37\times10^{-10}$ to $7.65\times10^{-10}$ to $1.03\times10^{-9}$ A/cm$^2$ in B-Po, for the ultrasonication duration from 0 (initial) to 90, 270 and 450 s, respectively. The increase in the corrosion current density with the ultrasonication in water is mainly caused by the loss of oil from the nanostructured surface. It should be noted that after ultrasonication for 450 s, the corrosion current density of the B-Pi surface increased by 58.2 fold, whereas the corrosion current density of the S-Po, L-Po and B-Po surfaces increased only by 3.6, 5.1 and 2.1 fold, respectively.

Such a significant increase in the corrosion current density in B-Pi is due to the inter-connected pore geometry which causes the severe loss of oil during ultrasonication in water. As already shown in the measurement of wetting properties, the inter-connected pore geometry of B-Pi is not effective in retaining the oil within the nanostructured layer against the external force or flow so that it yields the significant increase in the corrosion current after the ultrasonication. In contrast, also consistent with the measurement of wetting properties, the significantly smaller increase in the corrosion current density shown in the other surfaces indicates that the disconnected or isolated pore geometry is indeed effective to retain the oil within the nanostructured layer against the external disturbances.

It should be especially noted that the B-Po surface still showed the lowest current density and also the lowest increase in the corrosion current density in view of the ultrasonication for varying times, even though it has the same thickness of the porous oxide layer as S-Po and L-Po surfaces. This further indicates that the retentivity of the oil and the corresponding anti-corrosion longevity are significantly affected by the geometric features and shape of the pores such that the novel bottle-shaped pore geometry is still superior to the conventional cylindrical pore geometry in retaining the impregnated oil for the prevention from corrosion, even against the external disturbances.

Example 3: Effects of Pore Geometry on Self-Healing Capability

Figure 4B:
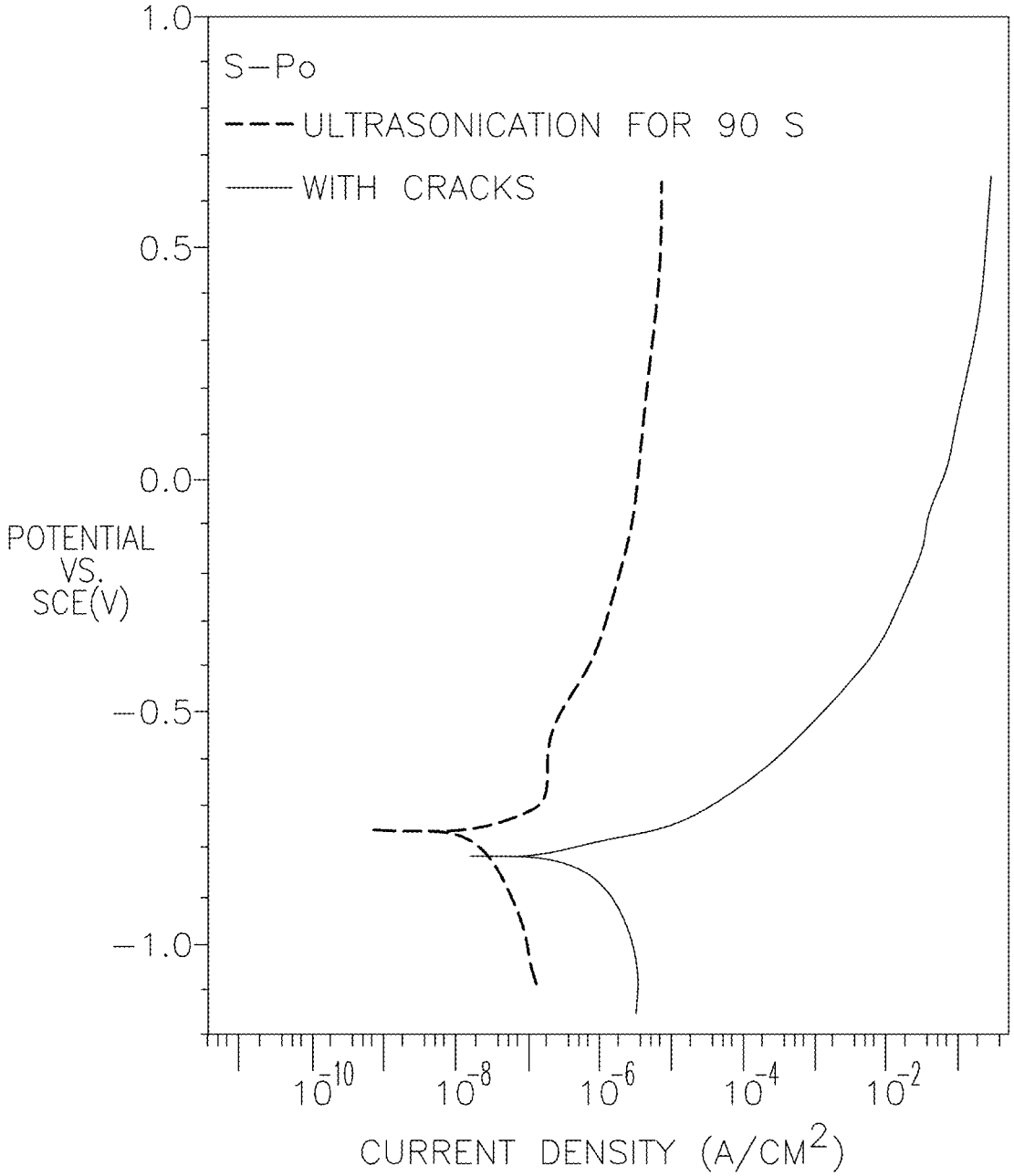
FIGS. 4B-4E are potentiodynamic polarization graphs illustrating the self-healing capability of the damaged oil-impregnated anodic aluminum oxide surfaces of FIGS. 4A1-4A4.
Figure 4C:
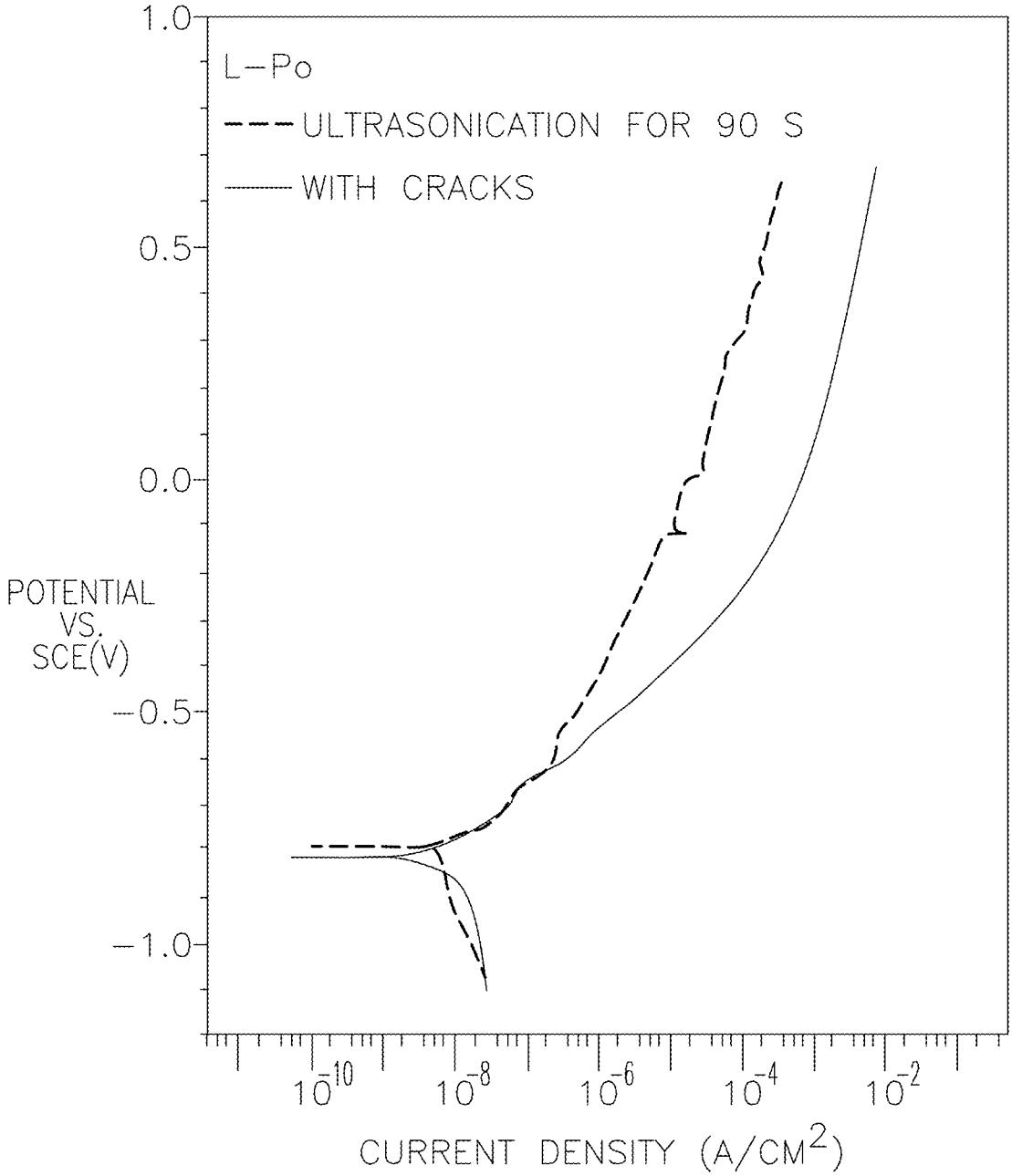
Figure 4D:
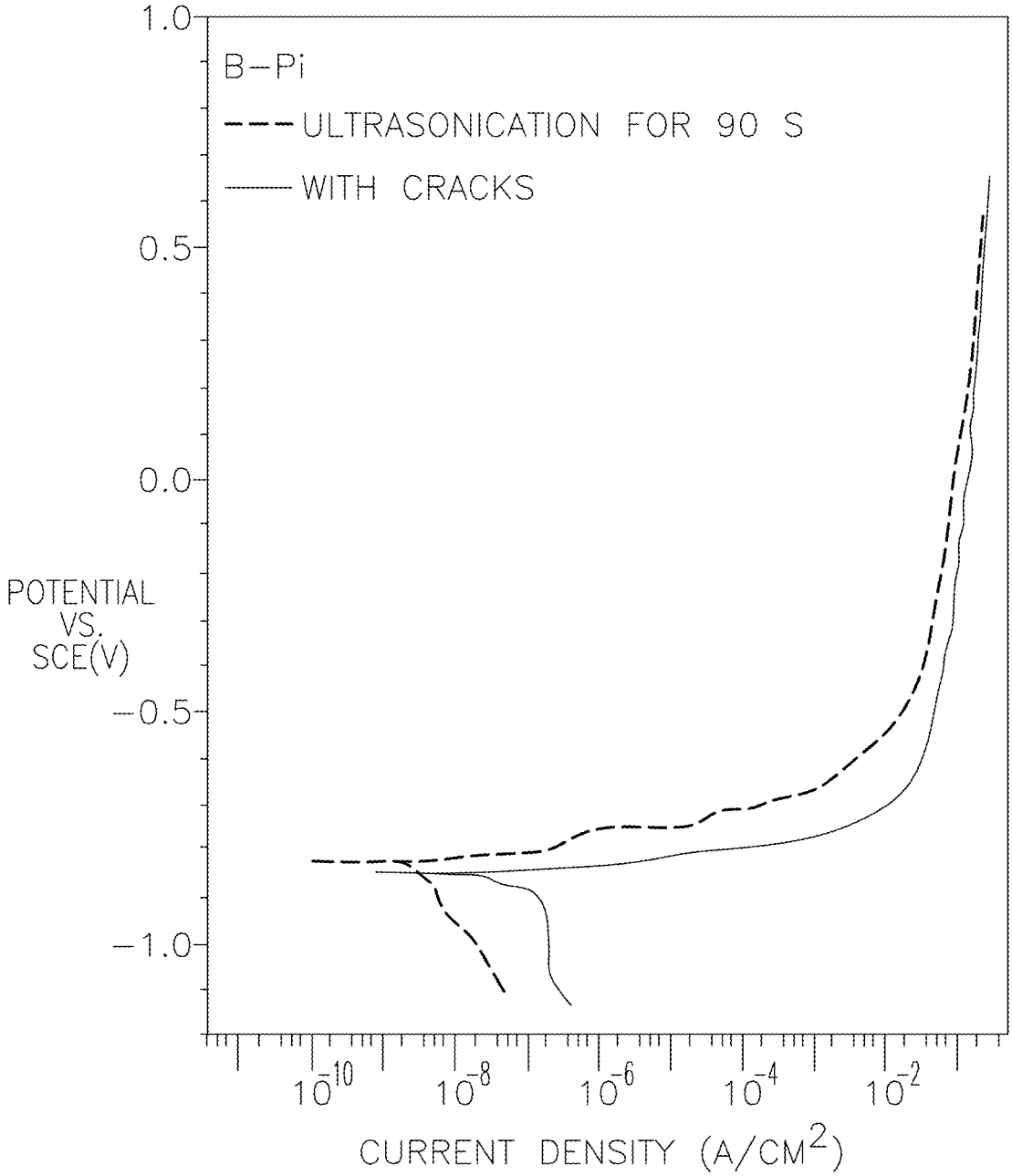
Figure 4E:
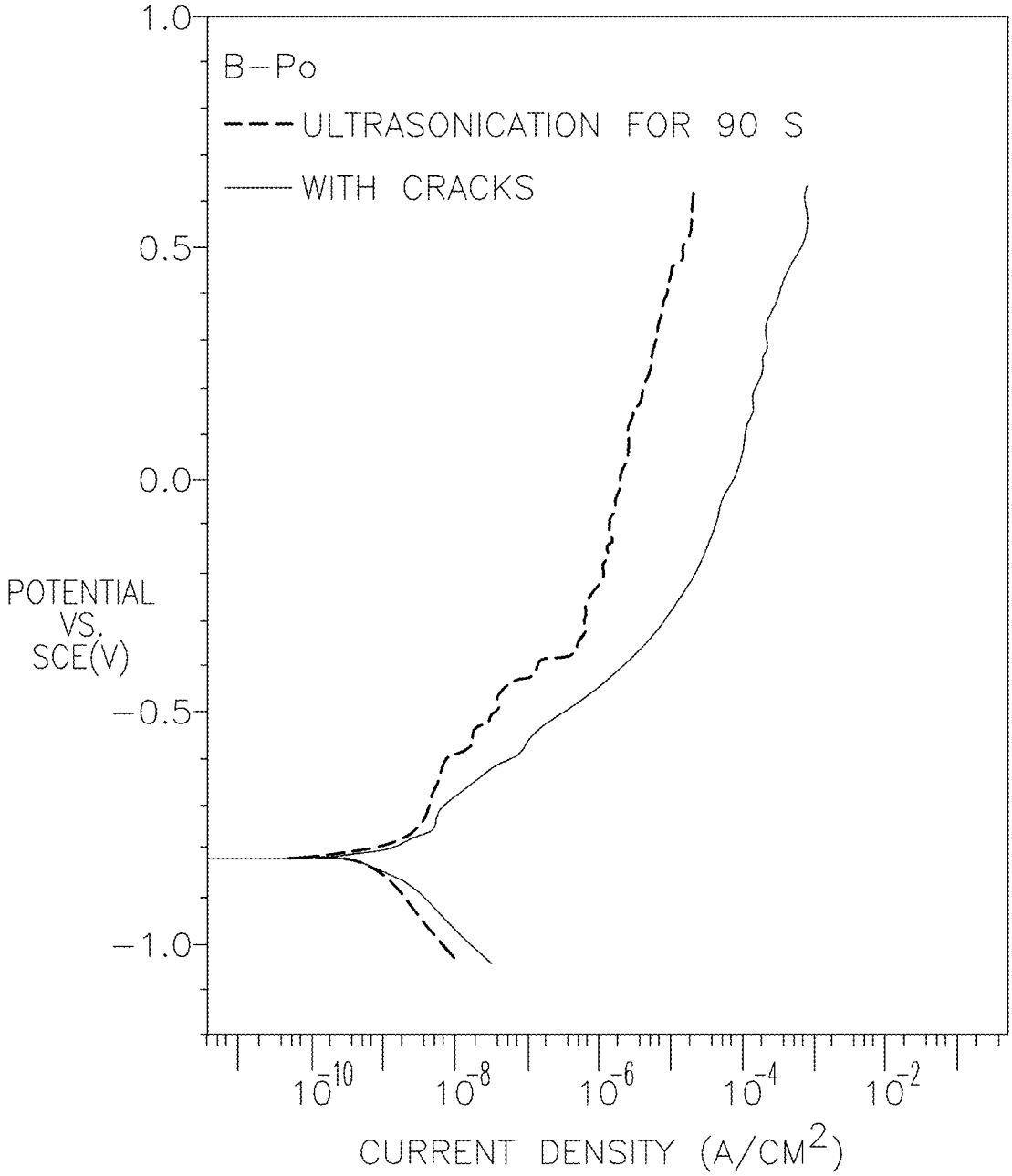
Figure 4F:
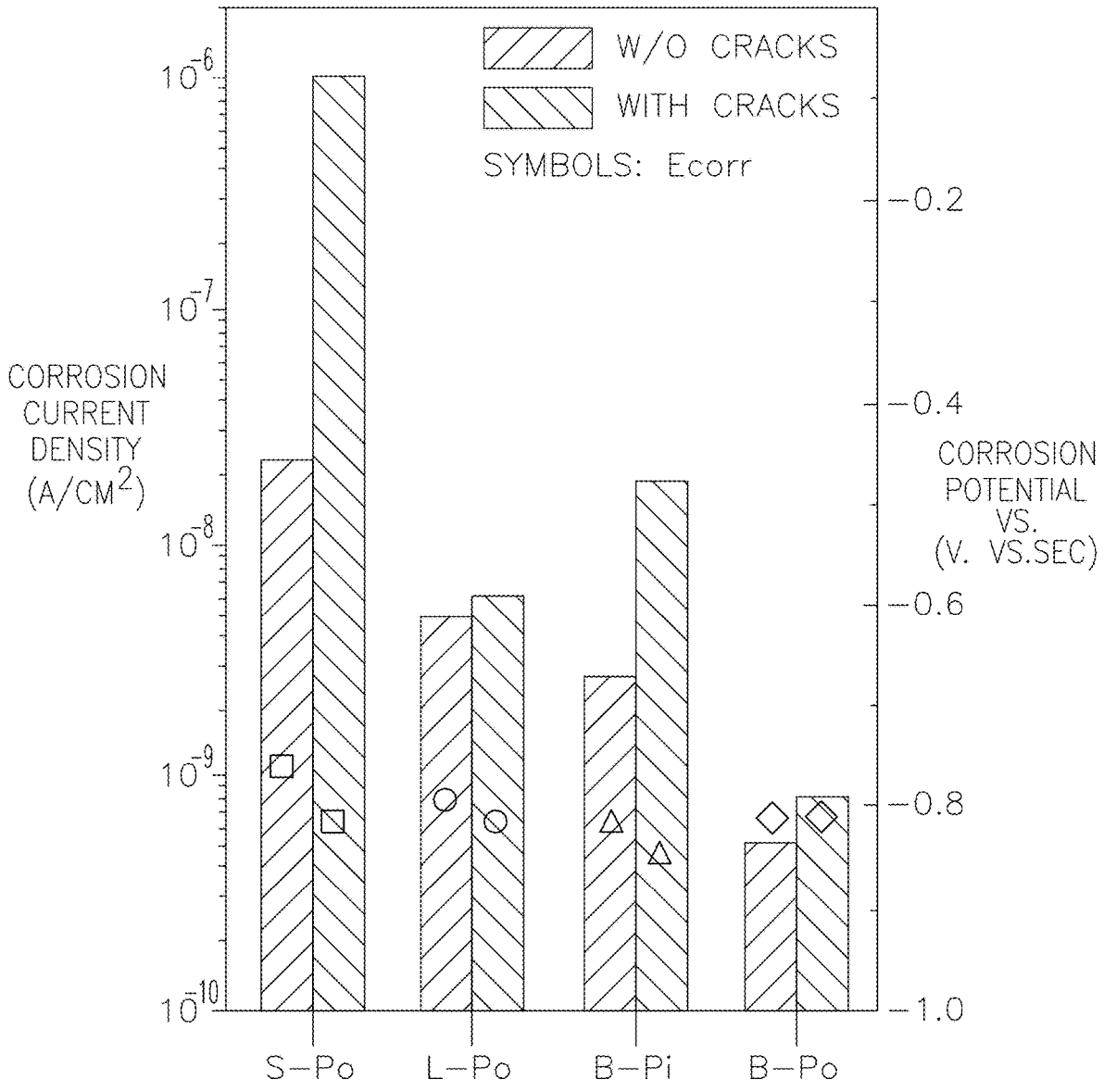
FIG. 4F is a chart comparing corrosion potential and current density for different surfaces before and after cracking.

Since the oil in the pores can immediately flows to an exposed area of the aluminum substrate upon damage, the self-healing capability is another advantage of oil-impregnated nanoporous oxide coatings. Since the geometrical shape and size of pores make differences in the amount of oil retained in the nanostructured layer, they can also affect the corrosion tolerance to the surface damage. In order to evaluate the corrosion tolerance of the oil-impregnated AAO layers to surface damage, the anti-corrosion efficacy of the surfaces were also measured after deliberately creating cracks in the surfaces by bending the oil-impregnated AAO samples against a cylindrical tube (2 cm diameter). Before creating the cracks, the excessive oil on the surface was removed through ultrasonication in water for 90 s. FIGS. 4A1-4A4 shows the AAO structures (S-Po, L-Po, B-Pi and B-Po) with cracks in the form of SEM images of intentionally damaged (i.e., cracked by bending) (i) S-Po, (ii) L-Po, (iii) B-Pi and (iv) B-Po surfaces. The cracks open up the AAO layer and expose the aluminum substrate under the damaged AAO layer to the outer environment.

FIGS. 4B-4E show the potentiodynamic polarization curves for the oil (Krytox GPL 100)-impregnated AAOs with the cracks, measured in 1 M HCl solution. They were also compared with the AAOs that were ultrasonicated for 90 s with no cracking. The increase in the corrosion current density by the cracks for each sample is also summarized in FIG. 4F. As the cracks in the AAO layers undermine the passivating capability of the oil-impregnated oxide layers against corrosion, the corrosion current density and the current density at anodic potential increase after the cracking. Although the cracks also affected (i.e., decreased) the corrosion potential of most samples (except B-Po), the changes in the corrosion current density were more significantly affected by the surface damage of cracks, such as from $2.23\times10^{-8}$ to $9.68\times10^{-7}$ A/cm$^2$ in S-Po, from $4.97\times10^{-9}$ to $5.93\times10^{-9}$ A/cm$^2$ in L-Po, from $2.69\times10^{-9}$ to $1.90\times10^{-8}$ A/cm$^2$ in B-Pi, and $5.37\times10^{-10}$ to $8.33\times10^{-10}$ A/cm$^2$ in B-Po. Among the samples, the S-Po surface showed the largest increase (43.5 fold) in the corrosion current density by the cracks, followed by the B-Pi (7.1 folds).

In contrast, the increase in the corrosion current density in the L-Po and B-Po surfaces by the cracks was only 1.2 and 1.5 fold, respectively. The result shows that the porosity (5%) of the S-Po surface was too small to provide a sufficient amount of oil to cover the damaged region upon cracking; consequently, the cracks provided a direct path for the penetration of corrosive liquid toward the aluminum substrate, resulting a dramatic increase in the corrosion current density. In contrast, the high porosity of the L-Po, Bi-Pi, and B-Po surfaces allowed for the impregnation of a greater amount of oil such that the oil could then cover the damaged area upon cracking in order to suppress the dramatic increase in the corrosion current density normally seen with surface damage. Moreover, the oil impregnated within the L-Po and B-Po layers, which have disconnected pore geometries, is more stably retained within than in the B-Pi layer having interconnected pore against the ultrasonication, such that the L-Po and B-Po surfaces show superior self-healing capability relative to B-Pi.

It should be noted that the B-Po surface still shows the lowest corrosion current density among the samples despite the surface damage. This indicates that the novel bottle-shaped pore geometry is also effective in providing superior corrosion tolerance and self-healing capability to the oil-impregnated nanoporous oxide layer, featuring not only the high retentivity of oil within the pores but also the high porosity to store a sufficient amount of oil to effectively passivate the damaged region autonomously.

Example 4: Effects of Oil Viscosity on Corrosion Resistance

To further examine the effect of oil viscosity on the corrosion resistance, B-Po surfaces impregnated with the perfluorinated oil with higher viscosity than that of Krytox™ GPL 100 (K100, 12.4 cSt at 20° C.) were also prepared and tested, including Krytox™ GPL 103 (K103, 82 cSt at 20° C.) and 106 (K106, 822 cSt at 20° C.). While the different viscosities of the oils (up to a factor of 66.3 times difference in the case of K106 and K100) do not make a significant difference in the wetting and mobility of a water droplet on the B-Po surface, when more viscous oil is impregnated within the B-Po structures, the corrosion resistance can be enhanced by inhibiting the penetration of corrosive liquid into the nanopores.

Figure 5A:
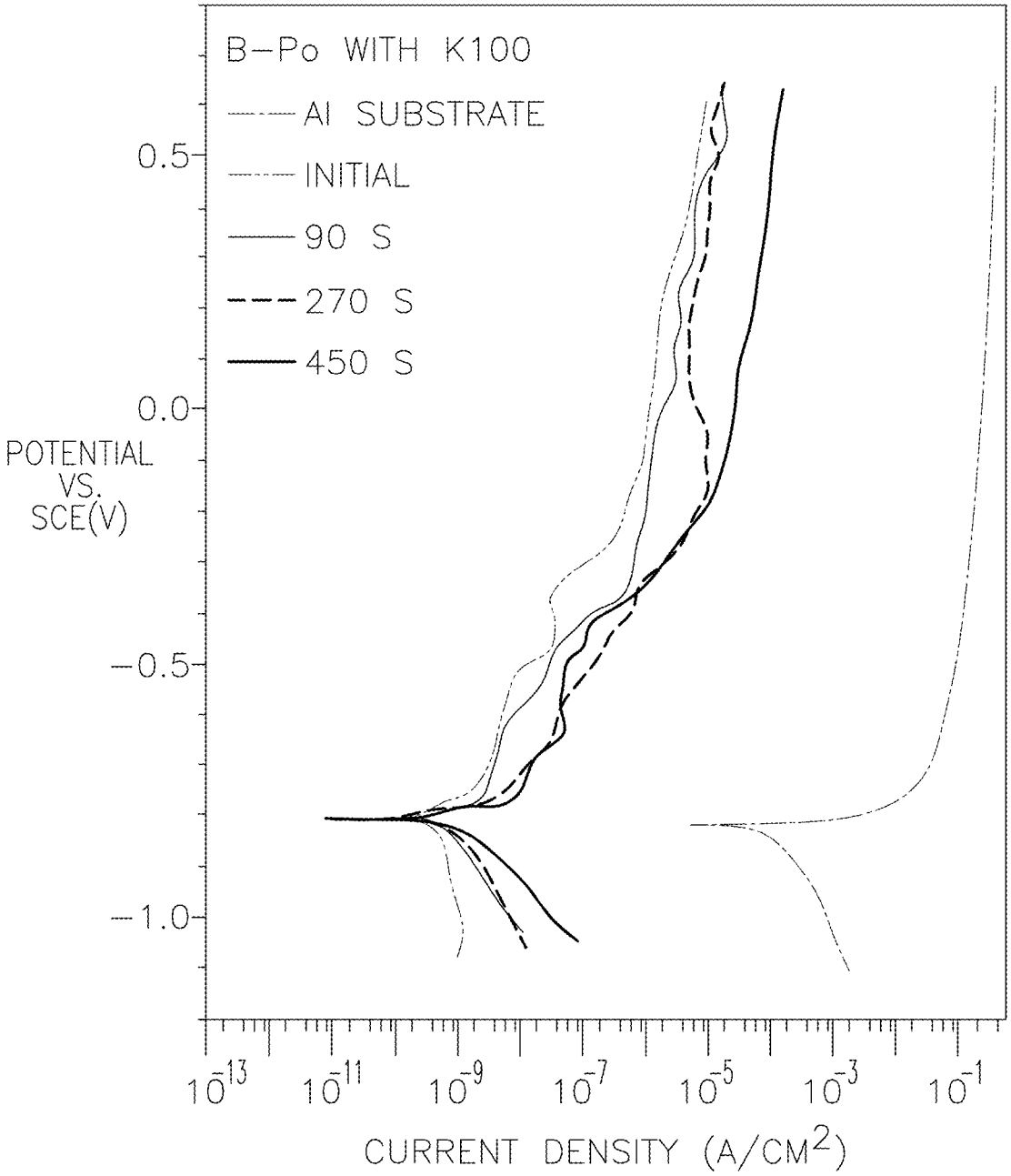
FIGS. 5A-5C are graphs illustrating the corrosion resistance of disconnected-pore surfaces impregnated with oils of varying viscosities in 1M HCl solution after ultrasonication in water for varying times.
Figure 5B:
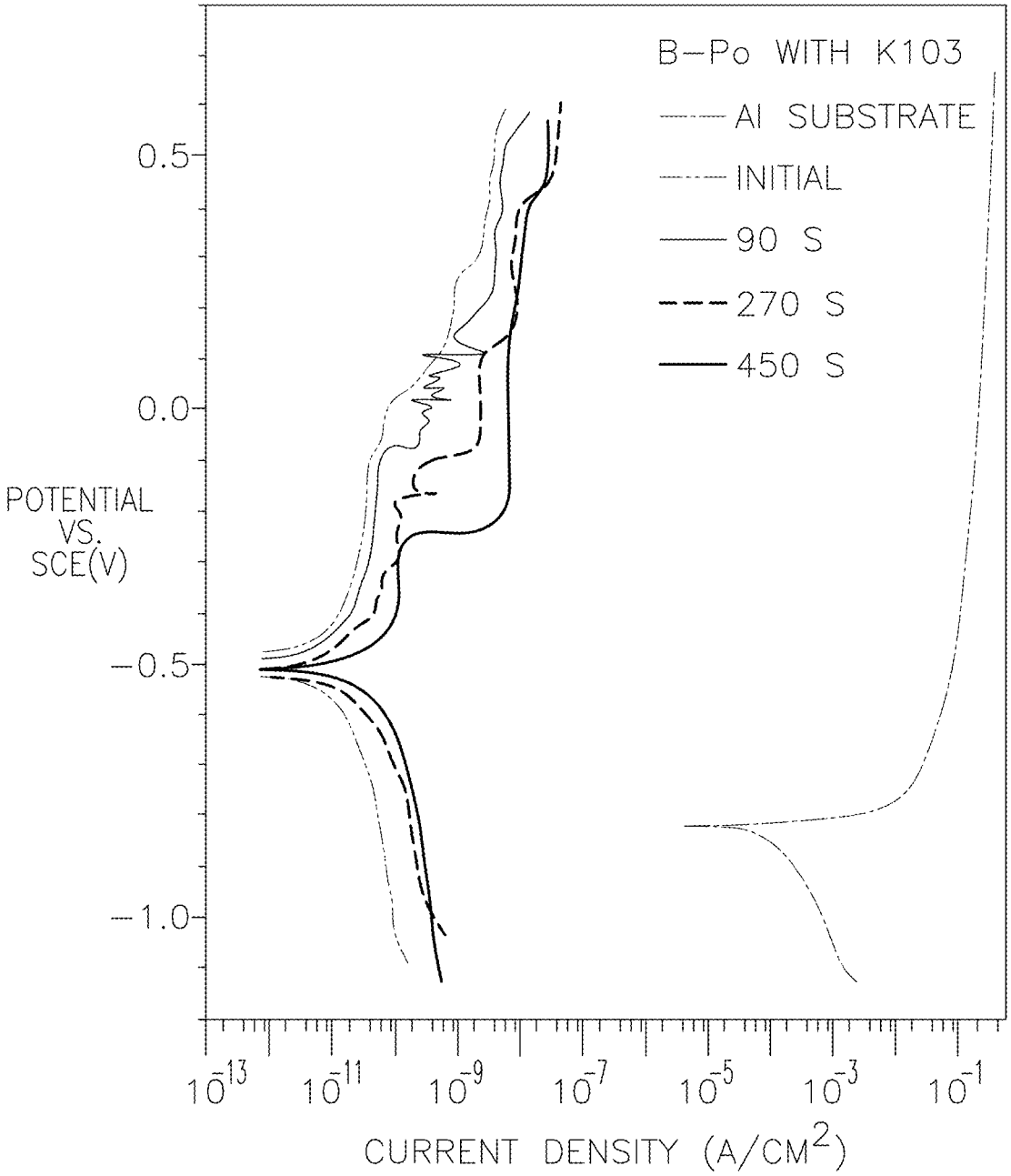
Figure 5C:
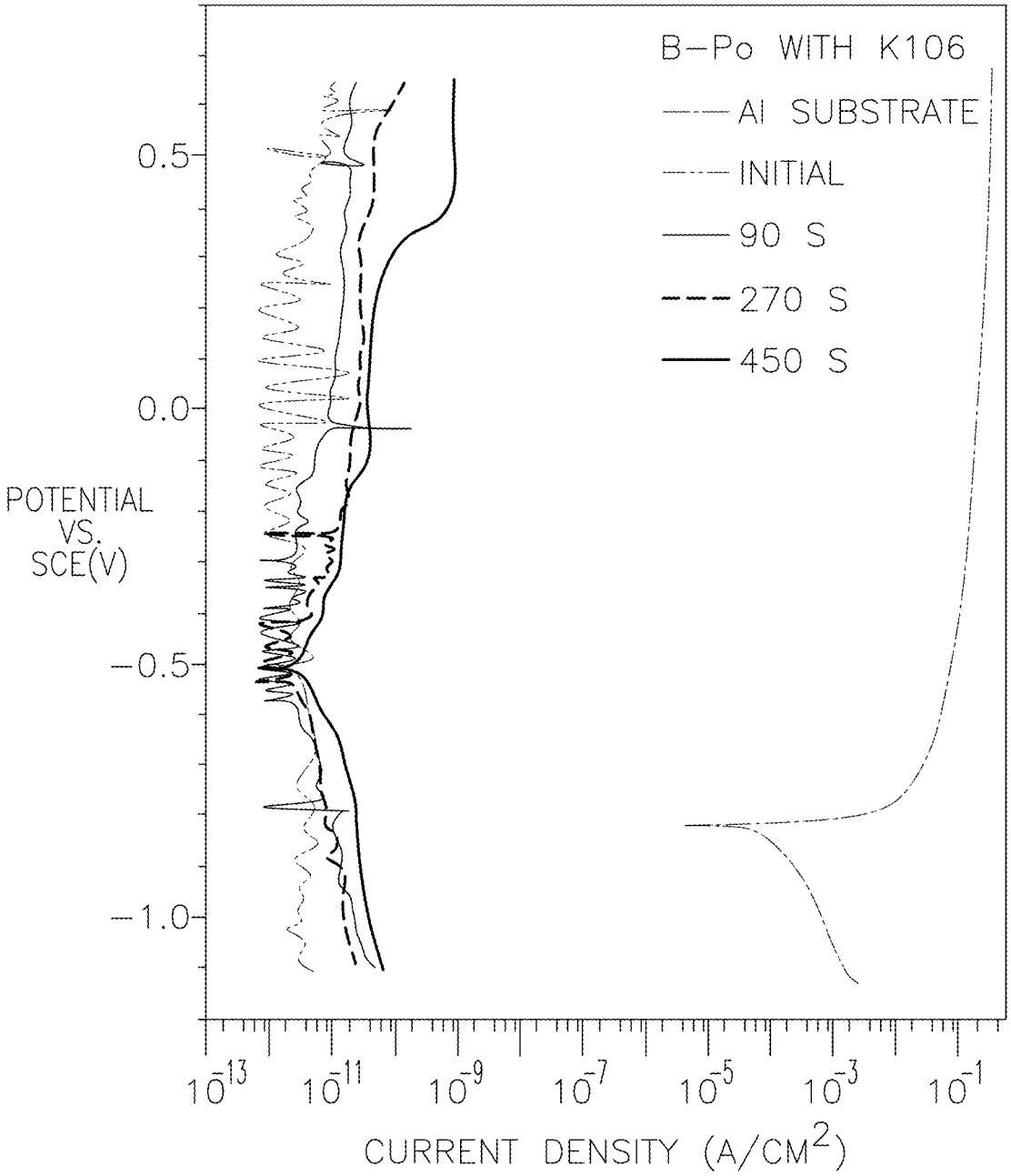
Figure 5D:
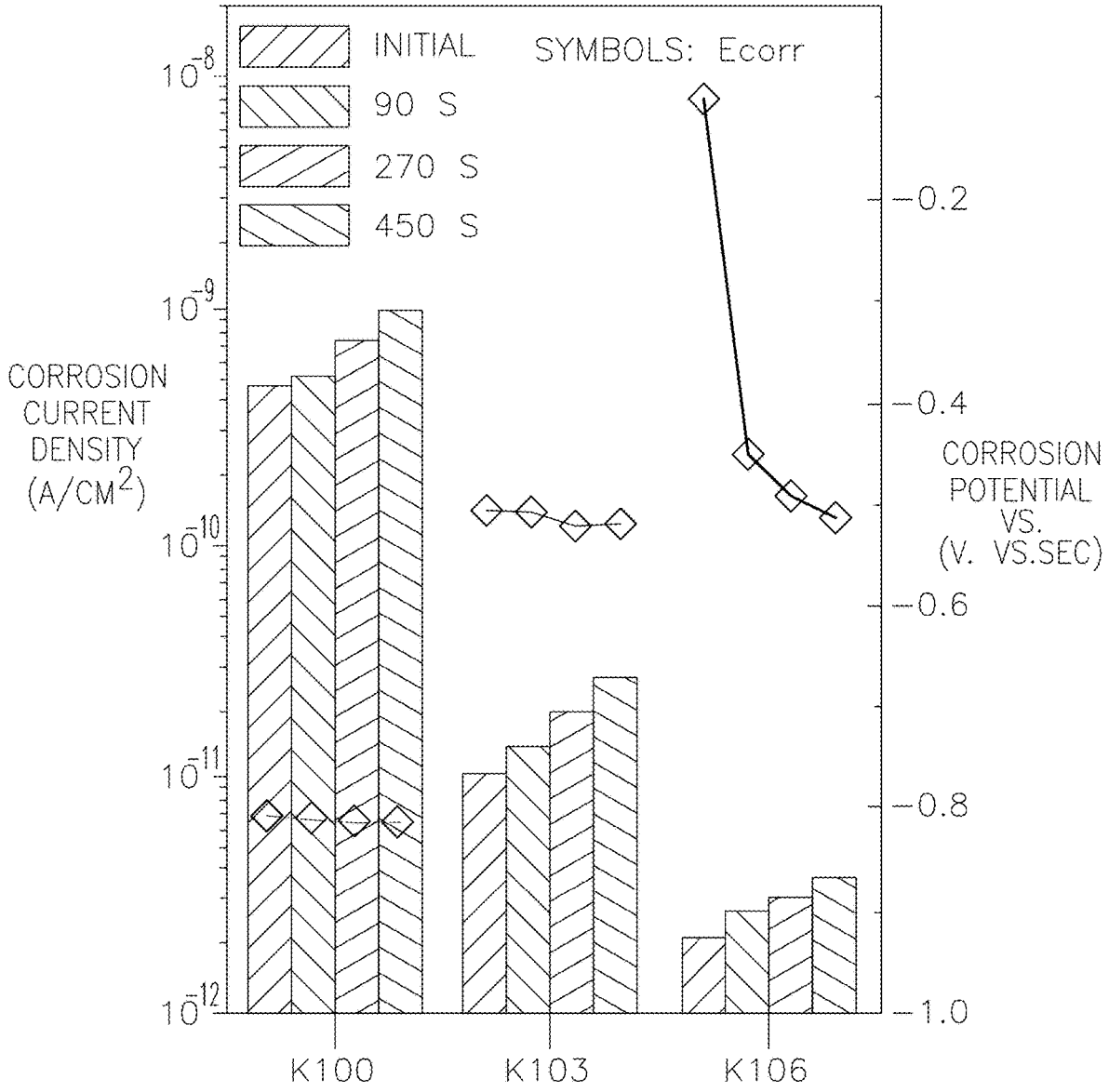
FIG. 5D is a graph comparing corrosion potential and current density of the surfaces of FIGS. 5A-5C.
Figure 6A:
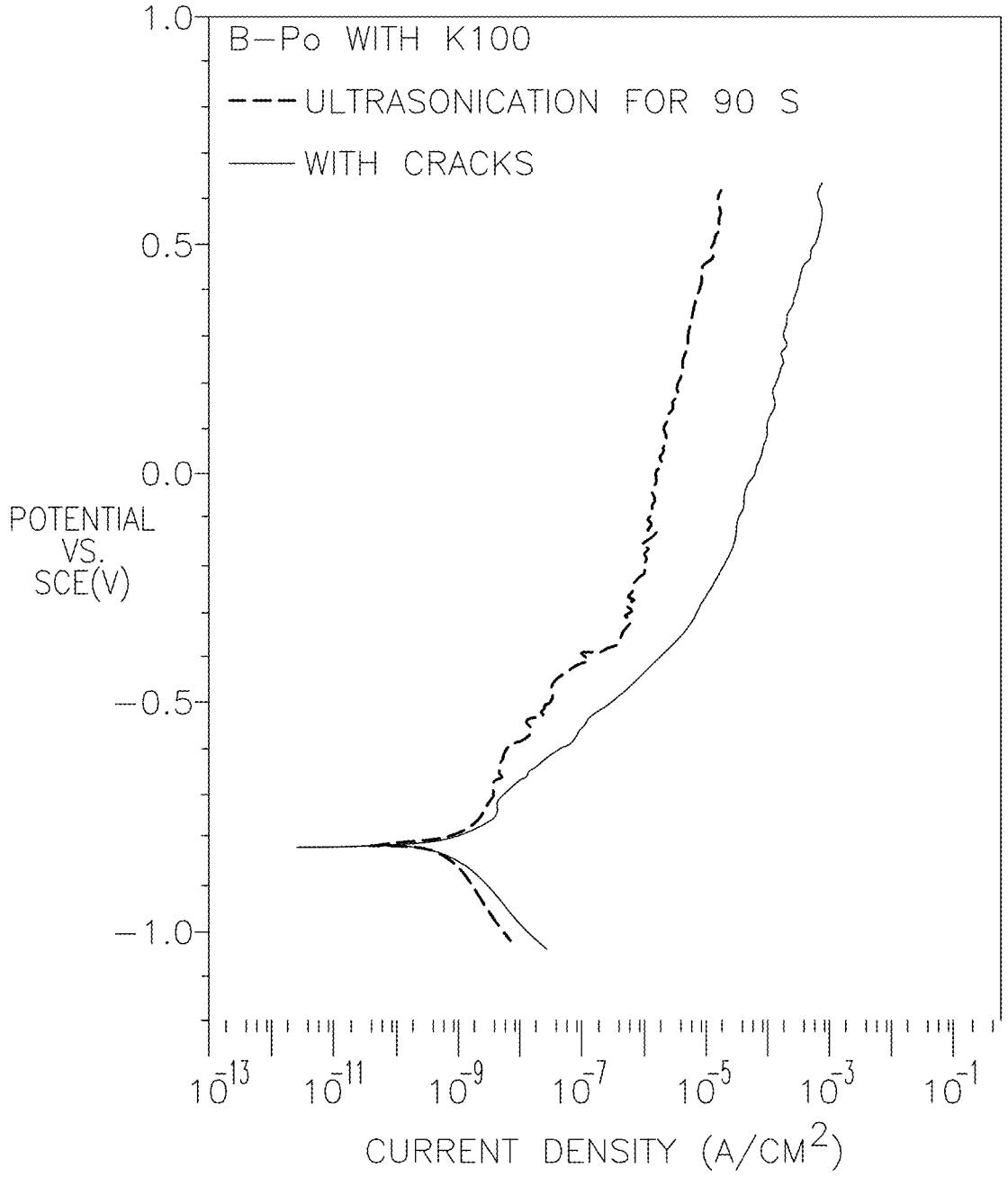
FIGS. 6A-6C are graphs illustrating the self-healing capability of the damaged oil-impregnated surfaces having disconnected pores and oils of varying viscosities.
Figure 6B:
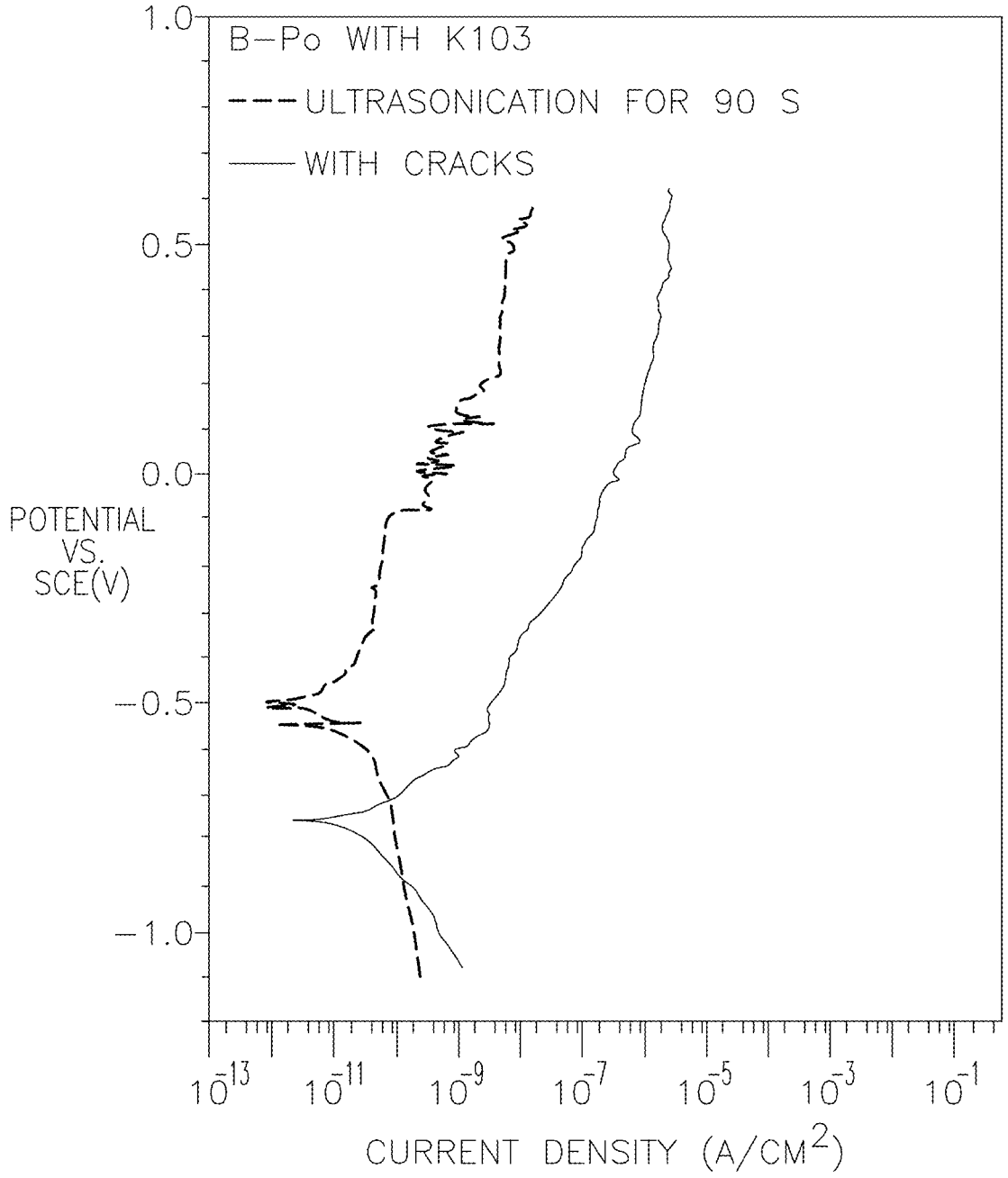
Figure 6C:
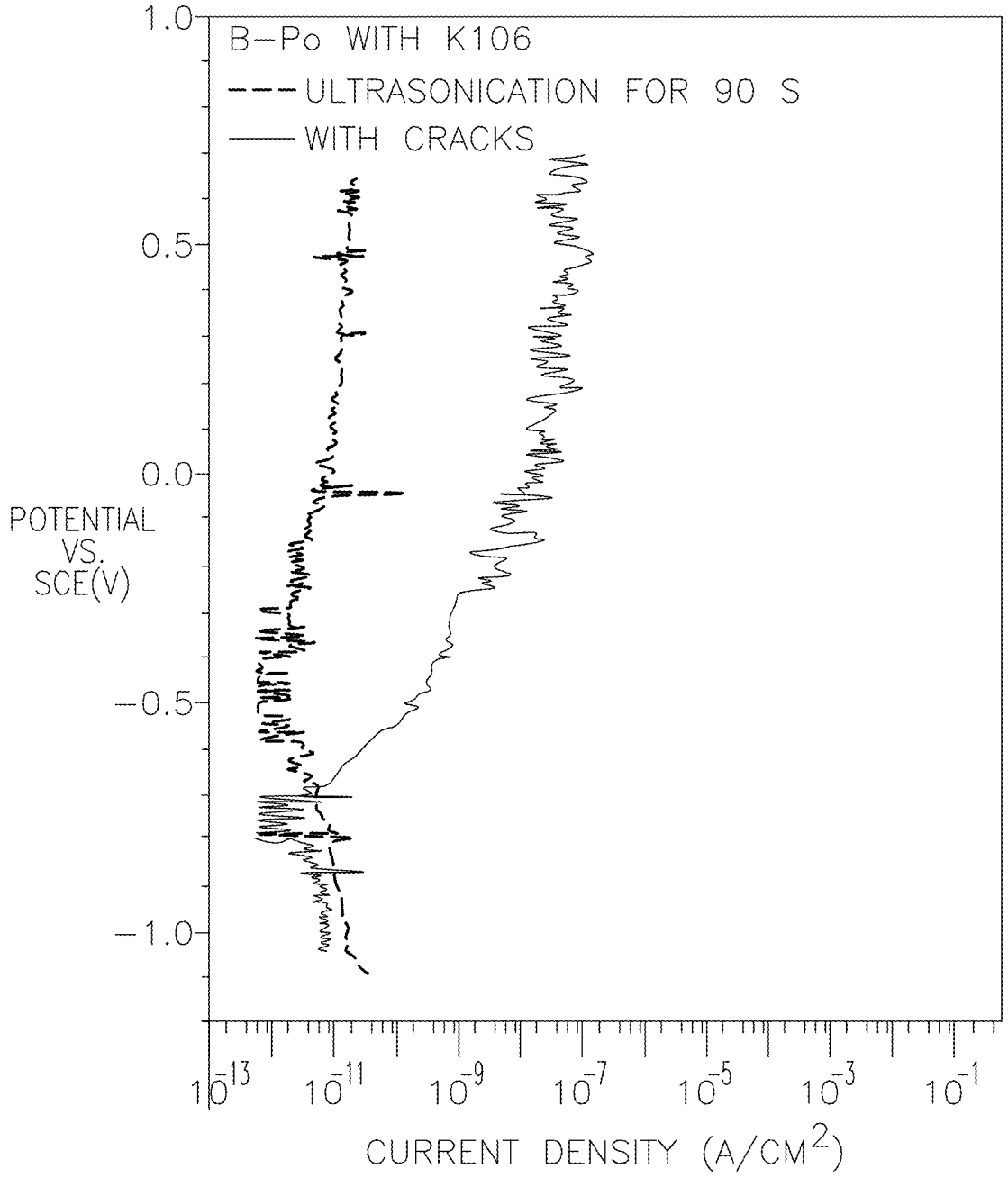
Figure 6D:
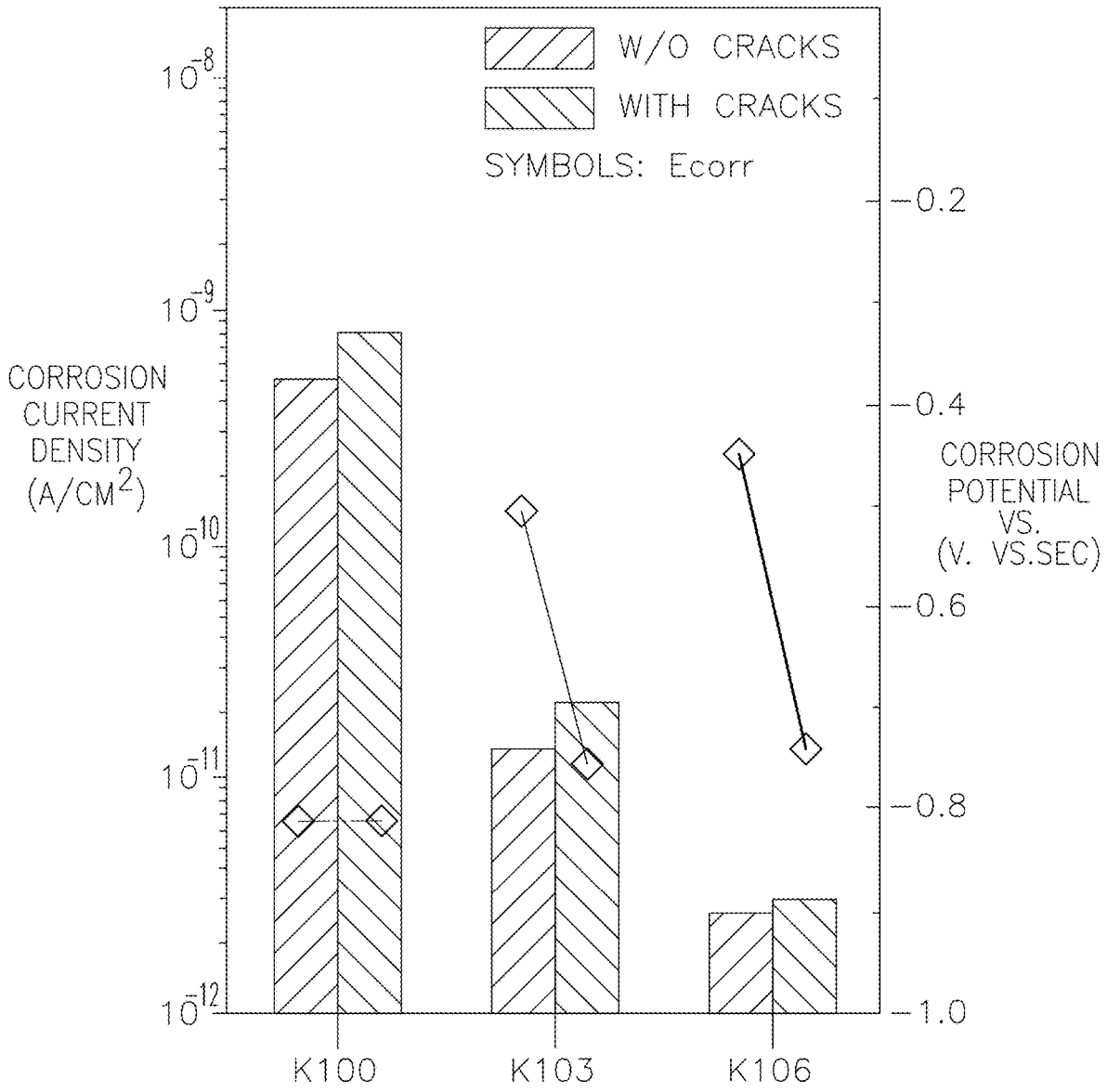
FIG. 6D is a chart comparing corrosion potential and current densities for the surfaces of FIGS. 6A-6C before and after intentionally damaging the surfaces.

FIGS. 5A-5C show the potentiodynamic polarization data measured in 1 M HCl solution to evaluate the corrosion resistance of the B-Po surfaces impregnated with the oils of three different viscosity values after ultrasonication in water for varying times. FIG. 5D further shows the comparison of the corrosion current density and potential of the three different B-Po samples. The corrosion current density increased from $4.87\times10^{-10}$ to $5.37\times10^{-10}$ to $7.65\times10^{-10}$ to $1.03\times10^{-9}$ A/cm$^2$ for the B-Po surface with K100, from $1.08\times10^{-11}$ to $1.39\times10^{-11}$ to $1.95\times10^{-11}$ to $2.35\times10^{-11}$ A/cm$^2$ for that with K103, from $2.12\times10^{-12}$ to $2.71\times10^{-12}$ to $3.13\times10^{-12}$ to $3.85\times10^{-12}$ A/cm$^2$ for that with K103 for ultrasonication durations from 0 s (initial), 90 s, 270 s and 450 s, respectively.

After the ultrasonication for 450 s, the increases in the corrosion current density are 112%, 118%, and 82% for the B-Po surfaces impregnated with K100, K103, and K106, respectively. While the B-Po surface with K103, which has a viscosity 6.6 times higher than that of K100, did not differ significantly from that with K100, the B-Po surface with K106, which has a viscosity 66.3 higher viscosity than that of K100, shows a significant decrease in the increase rate (i.e., from 112 to 82%). Meanwhile, despite the ultrasonication, the corrosion current densities of the B-Po surfaces with K103 and K106 remain much smaller (i.e., more than one and two orders of magnitudes, respectively) than that with K100. This indicates that the B-Po surface impregnated with oil having a higher viscosity is more effective at retaining the oil within the nanostructures and therefore has an enhanced the corrosion resistance by inhibiting the penetration of corrosive media toward the aluminum substrate through the nanopores.

Moreover, these results show that the combination of the pore geometry (i.e., bottle-shaped pores) and the viscosity of the impregnated oil can synergize to maximize the longevity and anti-corrosion efficacy of the oil-impregnated nanoporous oxide coatings.

Example 5: Effects of Oil Viscosity on Self-healing Capability

The self-healing capability of B-Po surfaces impregnated with the oils having different viscosities was also compared through a potentiodynamic polarization test in a 1 M HCl solution, before and after intentional damage (i.e., cracking), as shown in FIGS. 6A-6D. Before cracking, the samples were ultrasonicated in water for 90 s to remove the excessive oil on the surfaces. The measured corrosion current density of the samples increased after cracking: from $5.37\times10^{-10}$ to $8.33\times10^{-10}$ A/cm$^2$ (1.5 fold) in the B-Po surface with K100, from $1.39\times10^{11}$ to $2.18\times10^{11}$ A/cm$^2$ (1.5 fold) in the B-Po surface with K103, and from $2.71\times10^{12}$ to $3.15\times10^{12}$ A/cm$^2$ (1.2 fold) in the B-Po surface with K106.

While differences in the viscosity of the oils impregnated in the B-Po surfaces do not lead to significant differences in the increase rates, the trend indicating a lower corrosion current density in the B-Po surface impregnated with oil of higher viscosity is unchanged, and the B-Po surface with K106 still shows more than one and two orders of magnitudes lower corrosion current density than that with K103 and K100, respectively, even after the surface damage. The defective B-Po surface impregnated with K106 even shows lower corrosion current density than the intact B-Po surfaces impregnated with K100: $3.15\times10^{-12}$ and $5.37\times10^{10}$ A/cm$^2$, respectively. This indicates that using the oil having a high viscosity does not weaken the self-healing capability of the B-Po surface, but makes the B-Po surface more durable and robust for the anti-corrosion efficacy. Thus, the combination of the bottle-shaped pore geometry and the high viscosity of oil can offer a robust way to maximize the anti-corrosion efficacy of the oil-impregnated nanoporous oxide coatings.

Example 6: Salt Fog Test for Long-Term Durability

Figure 7A:
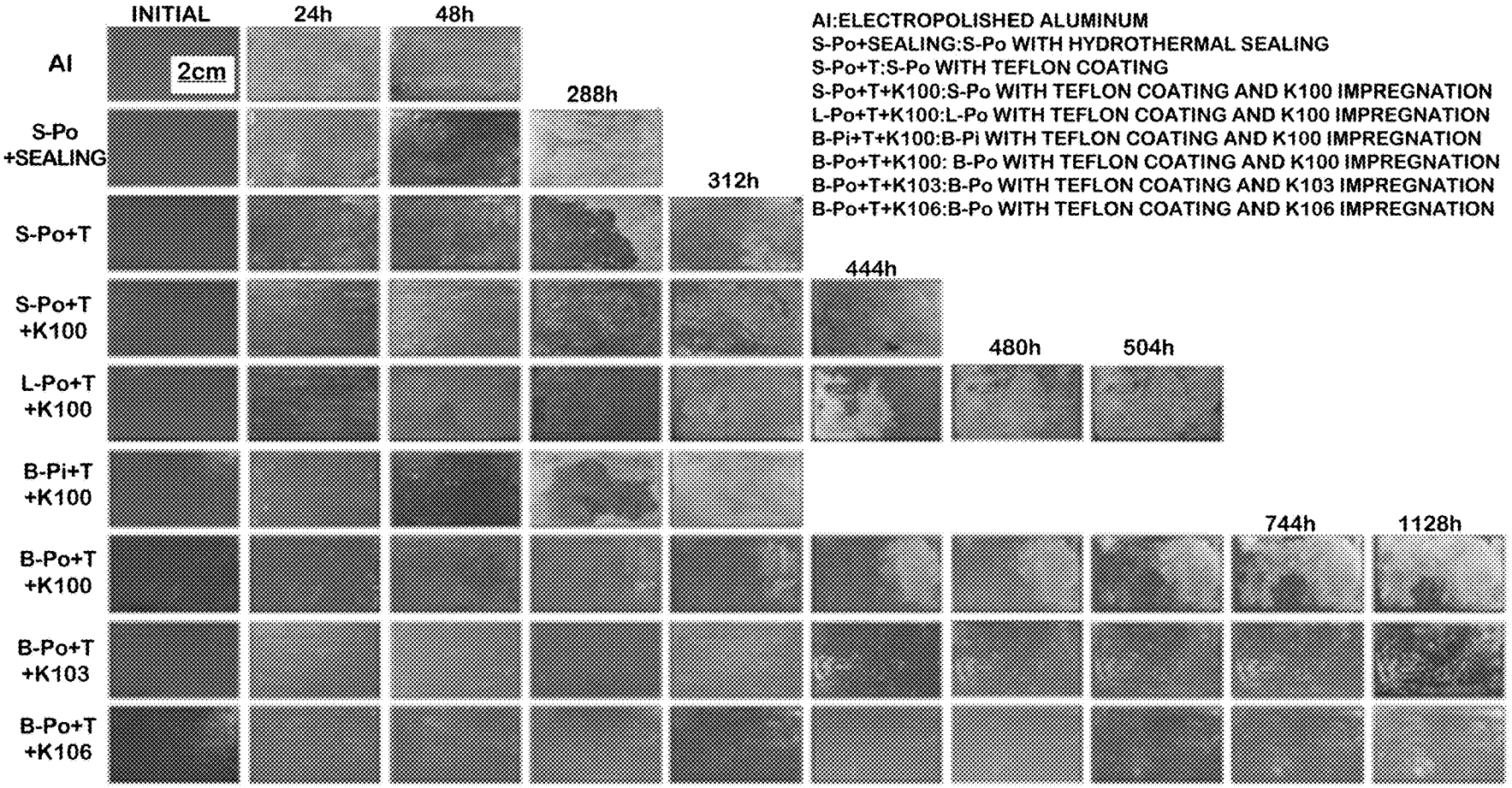
FIG. 7A is a series of optical images of surfaces prepared in accordance with an embodiment of the present invention, showing exposure of the surfaces to salt fog over time.

In order to further validate the long-term durability of the B-Po surfaces for anti-corrosion efficacy, a salt fog corrosion test was performed to test long-term corrosion in salt fog (NaCl 5 wt. % at 35° C.). In addition to the B-Po surfaces impregnated with the three different types of oils (i.e., B-Po+T+K100, B-Po+T+K103 and B-Po+T+K106) electropolished aluminum; a S-Po surface with a hydrothermal sealing (hydrophilic), which is a surface treatment widely used in current practices in industry; a S-Po surface with only a Teflon® coating (hydrophobic); and the S-Po, L-Po, and B-Pi surfaces impregnated with K100 oil were tested together for comparison. FIG. 7A shows the appearance of surfaces after the salt fog test for different exposure durations. The corrosion spots on the electropolished aluminum (Al) were formed in 24 h and the surface was totally faded in 48 h by the corrosion. The anodizing (i.e., oxidation) with hydrothermal sealing (S-Po+Sealing) and the anodizing with hydrophobization of Teflon® coating (S-Po+T) were effective in delaying the corrosion when compared to the electropolished aluminum. However, their entire surfaces were eventually corroded after 288 and 312 h, respectively. The oil-impregnation to the S-Po surface with K100 (S-Po+T+K100) further delayed the corrosion, but the surface was also fully corroded after 444 h. The L-Po surface (L-Po+T+K100), which had shown better oil retentivity and droplet mobility against external disturbance than the S-Po surface (S-Po+T+K100), showed a further delay of full corrosion to the 504 h mark. Meanwhile, the B-Pi surface (B-Pi+T+K100), which had shown poor oil retentivity and droplet mobility against external disturbance, was quicker to be corroded, taking 312 h for the full corrosion. In contrast, the B-Po surface (B-Po+T+K100), which had shown the best oil retentivity and droplet mobility against external disturbance with respect to the pore geometry, did not show full corrosion, even after 1128 h. Moreover, the B-Po surfaces impregnated with the oils having higher viscosities (B-Po+T+K103 and B-Po+T+K106) showed significantly less corrosion spots. In particular, the B-Po surface impregnated with the oil having the highest viscosity (B-Po+T+K106)

showed the superior anti-corrosion efficacy even after 1128 h. In addition to the increase in oil retentivity with the increase in the oil viscosity, the volatility (i.e., vapor pressure) of oil decreases with the increase in the oil viscosity. The reported vapor pressures of the oils are $1.92\times10^{-3}$, $1.60\times10^{-6}$, and $1.00\times10^{-8}$ torr at 20° C. for K100, K103, and K106, respectively. Thus, these results suggest that the B-Po surface impregnated with the oil having higher viscosity is more advantageous for the long-term durability against corrosion.

Figure 7B:
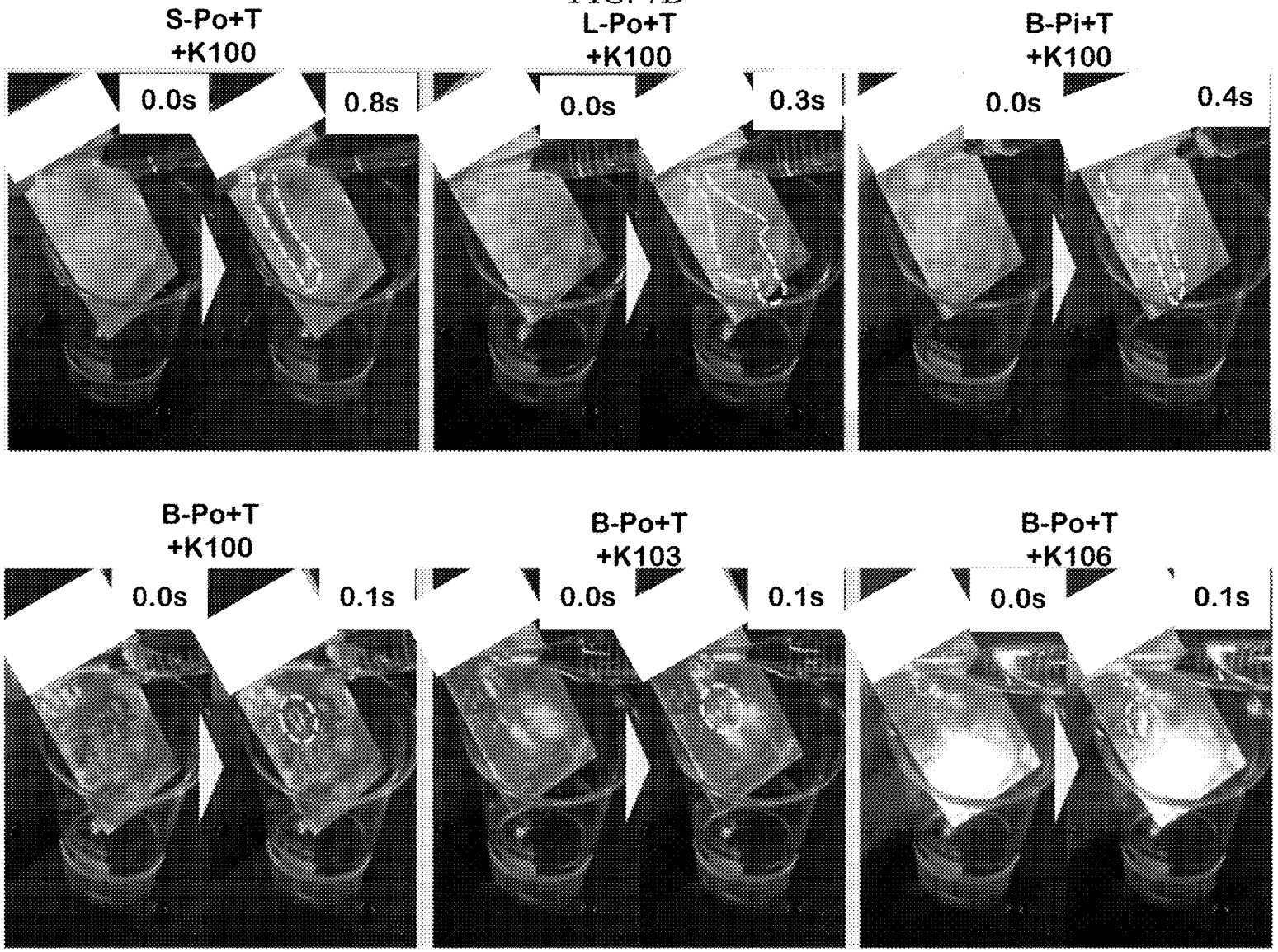
FIG. 7B is a series of sequential images of a water droplet dripping on the surfaces of FIG. 7A after prolonged exposure to salt fog.

In addition to the assessment of surface appearances, the mobility of a water droplet was also examined on the salt-fog tested surfaces, which further shows the durability of the surfaces. FIG. 7B shows the sequential images of a water droplet, which was dripped on the surfaces exposed to salt fog for 1128 h. On the S-Po, L-Po and B-Pi surfaces, which were totally corroded after the exposure to the salt fog, the water droplet easily wet the surface and showed significant pinning with little mobility, even on tilted surfaces. However, on the B-Po surfaces, the droplet could slide off with high mobility even after the exposure to the salt fog for 1128 h.

These results indicate that the oil on the surfaces was still retained to prevent the droplet from pinning. In the case of the B-Po surface impregnated with K100 (B-Po+T+K100), which showed the partial corrosion after the exposure to salt fog for 1128 h, some small droplets became pinned along the path of the sliding. However, such effects were less severe on the B-Po surfaces impregnated with the oil having a higher viscosity (i.e., B-Po+T+K103 and B-Po+T+K106) which have shown less significant corrosion even after the exposure to salt fog for 1128 h. These results further suggest that the B-Po surface impregnated with the oil having higher viscosity is a highly effective strategy to provide long-term durability and anti-corrosion efficacy to the oil-impregnated nanoporous oxide coatings. It should be noted that the thickness of the nanostructured AAO layers that were tested was only 1 μm, which is much thinner than that of the AAO layers generally used in many applications (e.g., at least several tens of micrometers).

Figure 7C:
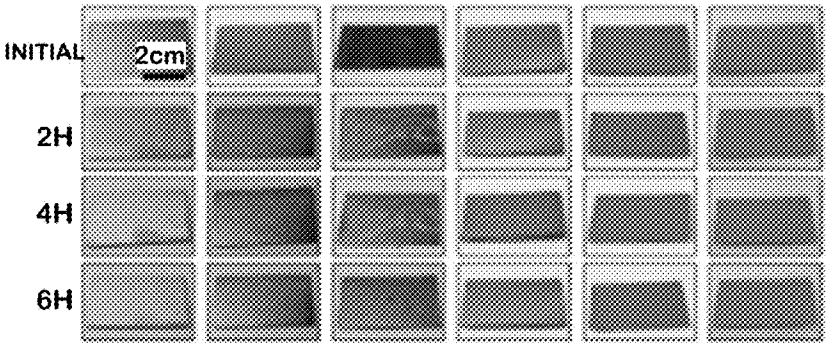
FIG. 7C is a series of optical images for the surfaces of FIG. 7B after progressive exposure to HCL vapor.
Figure 7D:
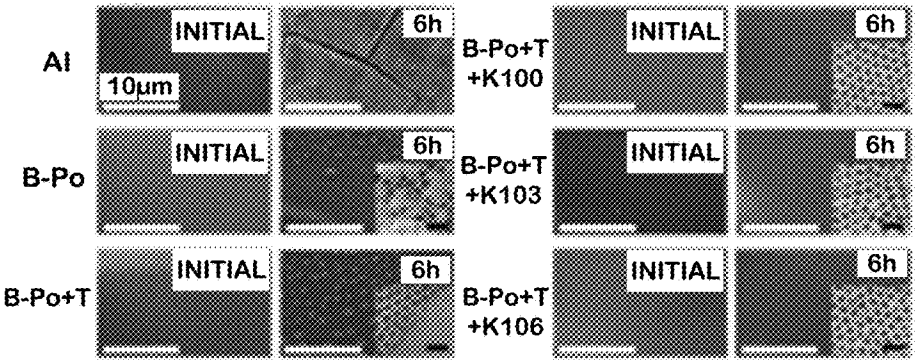
FIG. 7D is a series of SEM images of the surfaces of FIG. 7B after progressive exposure to HCL vapor.

The corrosion resistance of oil-impregnated surfaces in an atmospheric condition where the HCl gas can corrode the surface was also tested (see FIGS. 7C and 7D). Although the hydrophobic nanoporous oxide layer without lubricant impregnation (i.e., B-Po+T) was effective as a barrier layer in the case of a corrosive liquid, due to the air void retained within the hydrophobic pore structures (i.e., Cassie-Baxter state), the surface is unable to inhibit the transportation of vaporized corrosive media toward the metallic substrate in the case of atmospheric corrosive environment.

In contrast, the oil-impregnated surfaces (B-Po+T+K100, B-Po+T+K103 and B-Po+T+K106) exposed to the HCl vapor showed minimal differences in their surface appearances (FIG. 7C) as well as in their nanoporous structures (FIG. 7D). The fluorocarbon lubricant impregnated into the nanoporous oxide does not allow the permeation of corrosive media, even in the vapor phase, protecting both the nanoporous oxide layer and the underlying aluminum substrate. Therefore, the long-term durability and anti-corrosion efficacy can further be enhanced if a thicker AAO layer is used for the oil impregnation.

It will be understood that the embodiments described herein are merely exemplary and that a person skilled in the art may make many variations and modifications without departing from the spirit and scope of the invention. All such variations and modifications are intended to be included within the scope of the present invention.

What is claimed is:

1. In an anti-corrosive, self-healing coating for a metal surface, said coating comprising an anodic oxide layer which includes an inner surface adjacent the metal surface and an outer surface remote from the metal surface, said anodic oxide outer layer including a plurality of nanopores containing a quantity of corrosion-resistant liquid oil, said plurality of nanopores being distributed throughout said anodic oxide layer such that each nanopore of said plurality of nanopores is isolated from every other nanopore of said plurality of nanopores, each nanopore of said plurality of nanopores having walls which exhibit hydrophobic properties resulting from a hydrophobic/oleophilic coating layer comprising polytetrafluoroethylene, said walls extending longitudinally into said anodic oxide layer in a first direction from said outer surface thereof toward said inner surface thereof, the improvement wherein at least some of said plurality of nanopores have a bottle-shaped profile characterized by:

a neck region having (i) a first longitudinal dimension measured from said outer surface of said anodic oxide layer to a first point in an interior region of said anodic oxide layer and (ii) a first lateral dimension in a range from about 20 nm to about 200 nm, said first longitudinal dimension being greater than said first lateral dimension; and a body region having (iii) a second longitudinal dimension measured from said first point to a second point in an interior region of said anodic oxide layer between said first point and said inner surface of said anodic oxide layer, said second longitudinal dimension being greater than said first longitudinal dimension, and (iv) a second lateral dimension in a range from about 30 nm to about 500 nm, said second lateral dimension being less than said second longitudinal dimension and greater than said first lateral dimension, the ratio of said second lateral dimension to said first lateral dimension being no less than 1.5, wherein said first longitudinal dimension and said first lateral dimension of said neck region and said second longitudinal dimension and said second lateral dimension of said body region are selected such that said body region contains more of said liquid oil than said neck region, wherein said ratio is selected so as to (v) inhibit removal of said liquid oil from said body region of said at least some of said plurality of nanopores and (vi) promote the consequent enhanced retention of said quantity of liquid oil, thereby inhibiting contact and penetration of corrosive media toward the metal surface while promoting the self-healing properties of said coating, and said improvement being further characterized in that said liquid oil comprises fluorocarbon lubricant having a viscosity of 822 cST at 20° C., thereby further enhancing the self-healing properties of said coating.

2. The improved coating of claim 1, wherein said anodic oxide layer comprises aluminum oxide.

3. The improved coating of claim 1, wherein said quantity of liquid oil is sufficient to eliminate air from said at least some of said plurality of nanopores.

4. The improved coating of claim 1, wherein said first lateral dimension is between 32 and 40 nm.

5. The improved coating of claim 1, wherein said second lateral dimension is between 65 and 73 nm.

* * * * *